US010481511B2

(12) United States Patent
Shimizu et al.

(10) Patent No.: US 10,481,511 B2
(45) Date of Patent: Nov. 19, 2019

(54) ELECTROPHOTOGRAPHIC PHOTOSENSITIVE MEMBER, PROCESS CARTRIDGE, AND IMAGE FORMING APPARATUS

(71) Applicant: KYOCERA Document Solutions Inc., Osaka (JP)

(72) Inventors: Tomofumi Shimizu, Osaka (JP); Kiichiro Oji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/035,881

(22) Filed: Jul. 16, 2018

(65) Prior Publication Data

US 2019/0025721 A1 Jan. 24, 2019

(30) Foreign Application Priority Data

Jul. 21, 2017 (JP) ..... 2017-141460

(51) Int. Cl.
*G03G 5/05* (2006.01)
*G03G 5/06* (2006.01)

(52) U.S. Cl.
CPC ..... *G03G 5/056* (2013.01); *G03G 5/0592* (2013.01); *G03G 5/0596* (2013.01); *G03G 5/0614* (2013.01); *G03G 5/0618* (2013.01)

(58) Field of Classification Search
CPC ..... G03G 5/0564; G03G 5/056; G03G 5/0596
See application file for complete search history.

(56) References Cited

U.S. PATENT DOCUMENTS 5,120,627 A * 6/1992 Nozomi ..... G03G 5/0525 427/74
2015/0337079 A1* 11/2015 Ogawa ..... C08G 63/193 428/220
2017/0307989 A1* 10/2017 Azuma ..... G03G 5/0564
2018/0046098 A1* 2/2018 Shimizu ..... G03G 5/047
2018/0246402 A1* 8/2018 Azuma ..... G03C 1/7954
2018/0299797 A1* 10/2018 Shimizu ..... G03G 5/0567
2019/0025720 A1* 1/2019 Azuma ..... G03G 5/0618

FOREIGN PATENT DOCUMENTS

JP H10-288845 A 10/1998
WO WO-2018079117 A1 * 5/2018

OTHER PUBLICATIONS

English langauge machine translation of WO 2018/079117 (May 2018).*

* cited by examiner

*Primary Examiner* — Christopher D Rodee
(74) *Attorney, Agent, or Firm* — Studebaker & Brackett PC

(57) ABSTRACT

An electrophotographic photosensitive member includes a conductive substrate and a photosensitive layer. The photosensitive layer is a single-layer photosensitive layer and contains a charge generating material, a hole transport material, an electron transport material, and a binder resin. The binder resin has a viscosity average molecular weight of at least 25,000 and no greater than 50,000. A strain at break of the photosensitive layer is at least 4.9% and no greater than 13.0%. A scratch resistant depth of the photosensitive layer is no greater than 0.50 μm.

11 Claims, 7 Drawing Sheets

ELECTROPHOTOGRAPHIC PHOTOSENSITIVE MEMBER, PROCESS CARTRIDGE, AND IMAGE FORMING APPARATUS

INCORPORATION BY REFERENCE

The present application claims priority under 35 U.S.C. § 119 to Japanese Patent Application No. 2017-141460, filed on Jul. 21, 2017. The contents of this application are incorporated herein by reference in their entirety.

BACKGROUND

The present disclosure relates to an electrophotographic photosensitive member, a process cartridge, and an image forming apparatus.

Electrophotographic photosensitive members are used as image bearing members of electrophotographic image forming apparatuses (for example, printers and multifunction peripherals). Electrophotographic photosensitive members each include a photosensitive layer. Examples of electrophotographic photosensitive members include single-layer electrophotographic photosensitive members and multilayer electrophotographic photosensitive members. The single-layer electrophotographic photosensitive members each include a photosensitive layer having a charge generation function and a charge transport function. The multilayer electrophotographic photosensitive members each include a photosensitive layer including a charge generating layer having a charge generation function and a charge transport layer having a charge transport function.

One example of electrophotographic photosensitive members contains a polyarylate resin represented by chemical formula (R-A) shown below in the photosensitive layer.

ber. The charger charges a surface of the image bearing member. The charger has a positive charging polarity. The light exposure section exposes the charged surface of the image bearing member to light to form an electrostatic latent image on the surface of the image bearing member. The development section develops the electrostatic latent image into a toner image. The transfer section transfers the toner image from the image bearing member to a transfer target while bringing the transfer target into contact with the surface of the image bearing member.

(R-A)

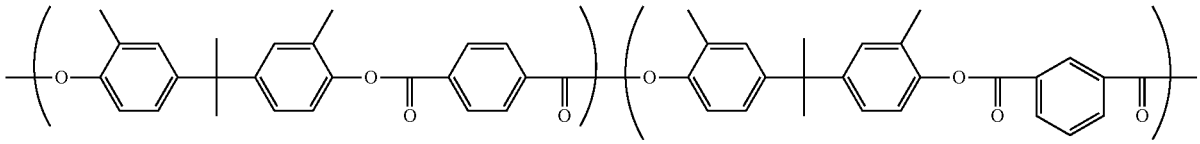

SUMMARY

An electrophotographic photosensitive member according to an aspect of the present disclosure includes a conductive substrate and a photosensitive layer. The photosensitive layer is a single-layer photosensitive layer and contains a charge generating material, a hole transport material, an electron transport material, and a binder resin. The binder resin has a viscosity average molecular weight of at least 25,000 and no greater than 50,000. A strain at break of the photosensitive layer is at least 4.9% and no greater than 13.0%. A scratch resistant depth of the photosensitive layer is no greater than 0.50 μm.

A process cartridge according to another aspect of the present disclosure includes the above-described electrophotographic photosensitive member.

Figure 8:
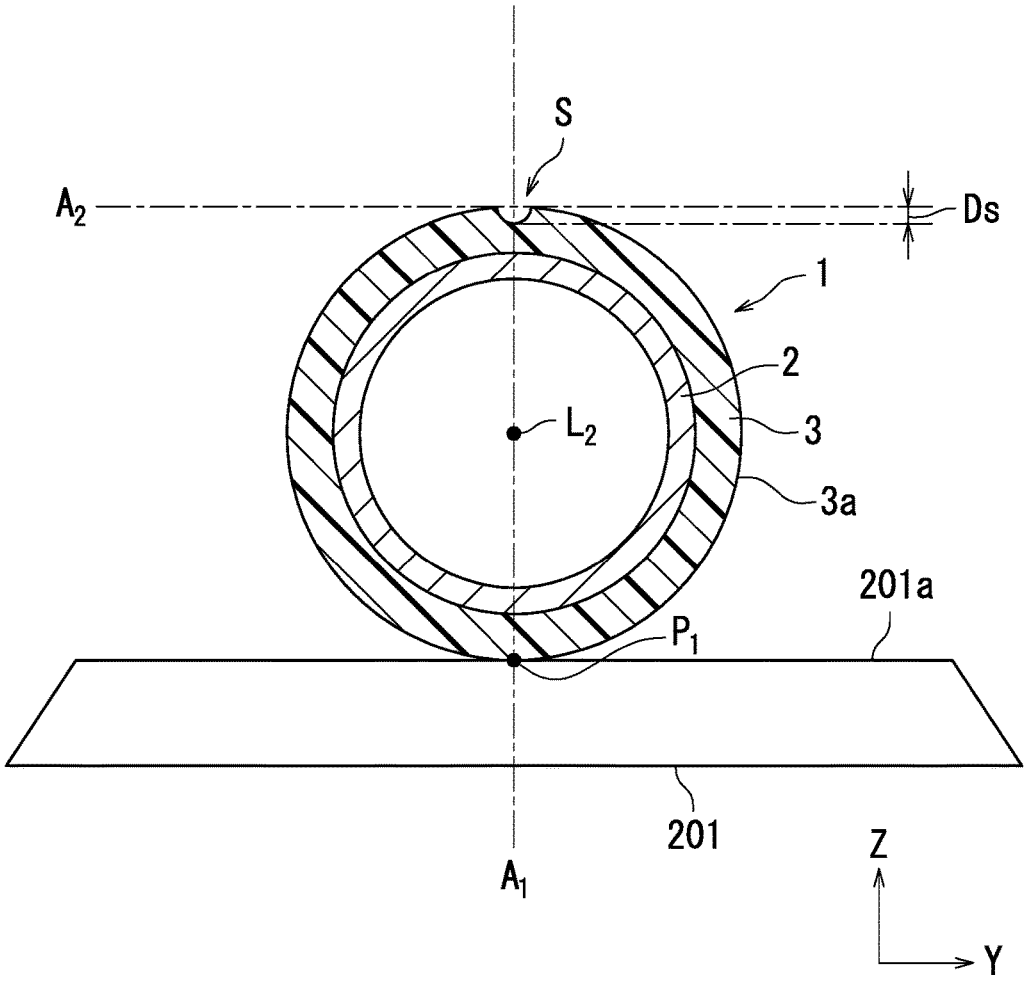

An image forming apparatus according to another aspect of the present disclosure includes an image bearing member, a charger, a light exposure section, a development section, and a transfer section. The image bearing member is the above-described electrophotographic photosensitive mem- FIG. 8 is a diagram illustrating a scratch created on a surface of a photosensitive layer.

Figure 9:
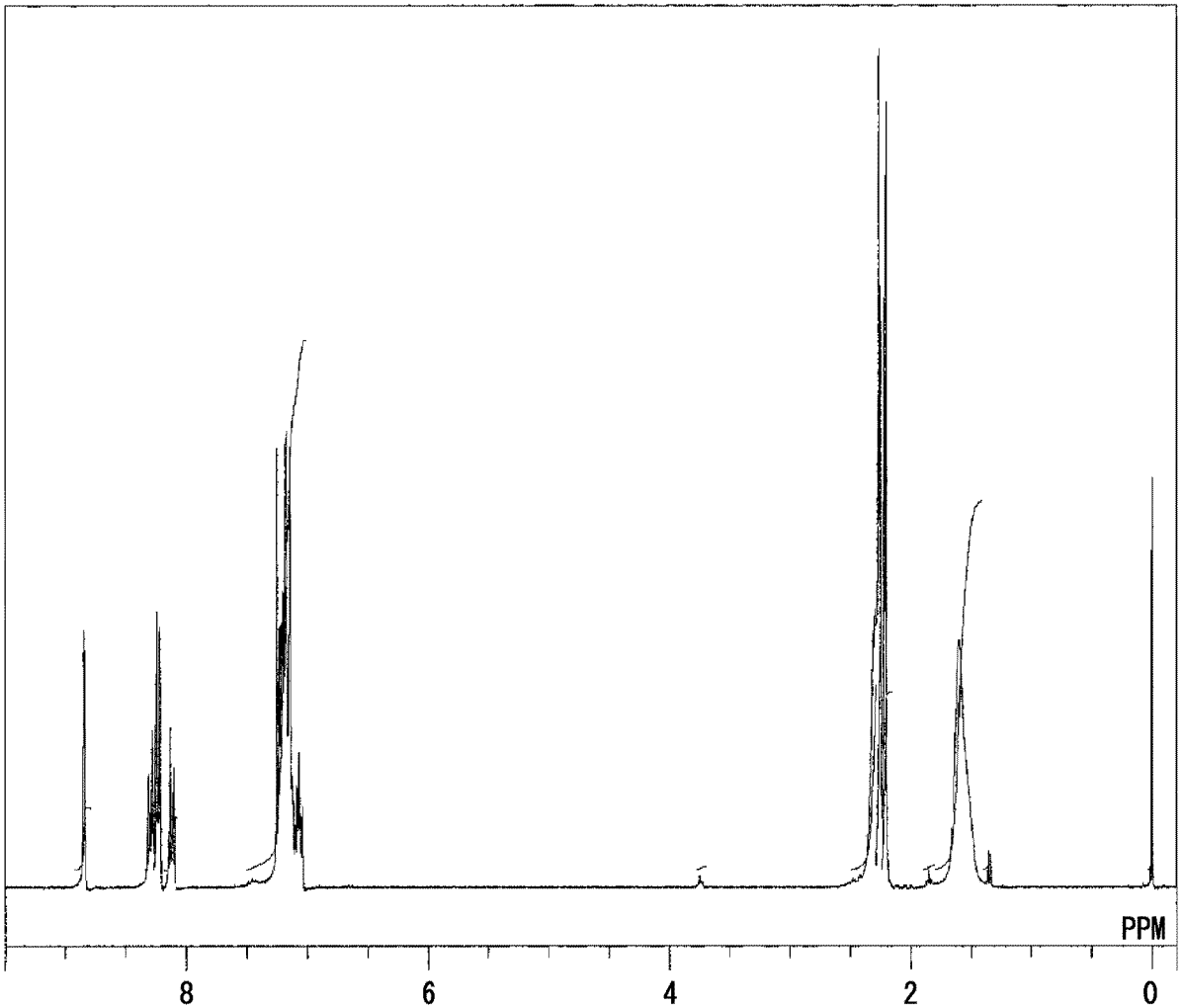

FIG. 9 is a $^{1}$H-NMR spectrum of a polyarylate resin (R-1-1).

DETAILED DESCRIPTION

The following describes embodiments of the present disclosure in detail. However, the present disclosure is not in any way limited by the following embodiments and appropriate changes may be made when practicing the present disclosure so long as such changes do not deviate from the intended scope of the present disclosure. Although description is omitted as appropriate in some instances in order to avoid repetition, such omission does not limit the essence of the present disclosure. Hereinafter, the term "-based" may be appended to the name of a chemical compound in order to form a generic name encompassing both the chemical compound itself and derivatives thereof. Also, when the term "-based" is appended to the name of a chemical compound used in the name of a polymer, the term indicates that a repeating unit of the polymer originates from the chemical compound or a derivative thereof.

Hereinafter, an alkyl group having a carbon number of at least 1 and no greater than 6 and an alkoxy group having a carbon number of at least 1 and no greater than 6 each refer to the following.

An alkyl group having a carbon number of at least 1 and no greater than 6 as used herein refers to an unsubstituted straight chain or branched chain alkyl group. Examples of the alkyl group having a carbon number of at least 1 and no greater than 6 include a methyl group, an ethyl group, a propyl group, an isopropyl group, an n-butyl group, an s-butyl group, a t-butyl group, a pentyl group, an isopentyl group, a neopentyl group, and a hexyl group.

An alkoxy group having a carbon number of at least 1 and no greater than 6 as used herein refers to an unsubstituted straight chain or branched chain alkoxy group. Examples of the alkoxy group having a carbon number of at least 1 and no greater than 6 include a methoxy group, an ethoxy group, an n-propoxy group, an isopropoxy group, an n-butoxy group, an s-butoxy group, a t-butoxy group, a pentyloxy group, an isopentyloxy group, a neopentyloxy group, and a hexyloxy group.

First Embodiment: Electrophotographic Photosensitive Member

Figure 1:
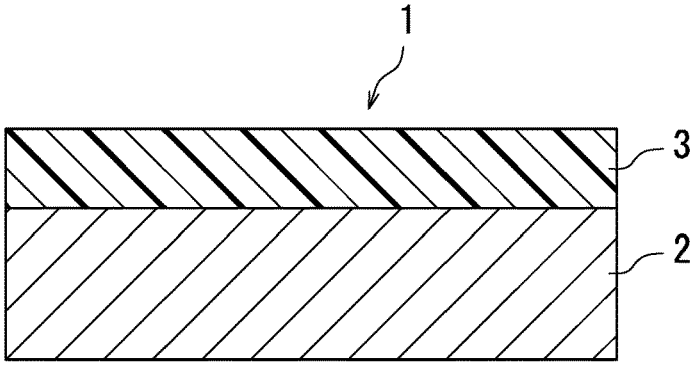
FIG. 1 is a partial cross-sectional view illustrating an example of a structure of an electrophotographic photosensitive member according to a first embodiment of the present disclosure.
Figure 2:
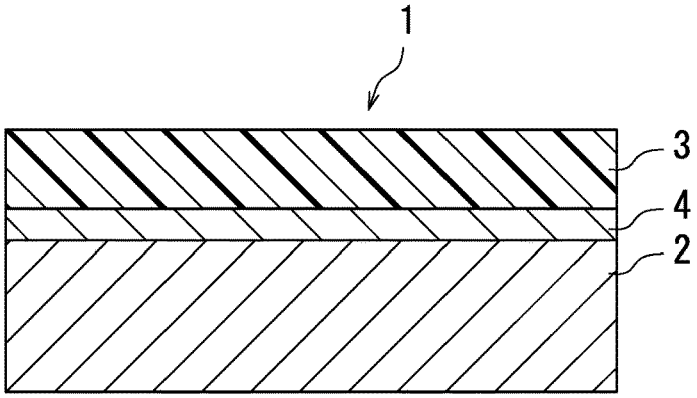
FIG. 2 is a partial cross-sectional view illustrating an example of the structure of the electrophotographic photosensitive member according to the first embodiment of the present disclosure.
Figure 3:
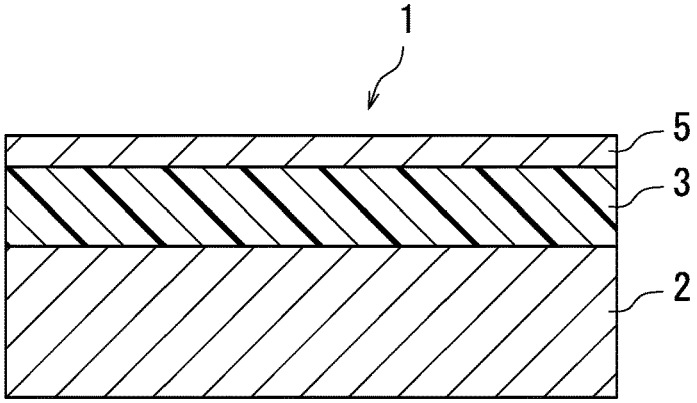
FIG. 3 is a partial cross-sectional view illustrating an example of the structure of the electrophotographic photosensitive member according to the first embodiment of the present disclosure.

The following describes a structure of an electrophotographic photosensitive member (also referred to below as a photosensitive member) according to a first embodiment of the present disclosure. FIGS. 1, 2, and 3 are partial cross-sectional views illustrating the structure of a photosensitive member 1, which is an example of the first embodiment. As illustrated in FIG. 1, the photosensitive member 1 includes a conductive substrate 2 and a photosensitive layer 3. The photosensitive layer 3 is a single-layer photosensitive layer. The photosensitive layer 3 may be disposed directly on the conductive substrate 2 as illustrated in FIG. 1. Alternatively, the photosensitive member 1 may for example include the conductive substrate 2, an intermediate layer (for example, an under layer) 4, and the photosensitive layer 3 as illustrated in FIG. 2. In an example illustrated in FIG. 2, the photosensitive layer 3 is provided on the intermediate layer 4 on the conductive substrate 2. A protective layer 5 may be provided as an outermost layer of the photosensitive member 1 as illustrated in FIG. 3.

The following describes elements (the conductive substrate 2, the photosensitive layer 3, and the intermediate layer 4) of the photosensitive member 1. The following further describes a method for producing the photosensitive member 1.

[1. Conductive Substrate]

No particular limitations are placed on the conductive substrate 2 other than being a conductive substrate that can be used in the photosensitive member 1. The conductive substrate 2 can be a conductive substrate of which at least a surface portion is made from a conductive material. Examples of the conductive substrate 2 include a conductive substrate made from an electrically conductive material (conductive material) and a conductive substrate having a conductive material coating. Examples of conductive materials that can be used include aluminum, iron, copper, tin, platinum, silver, vanadium, molybdenum, chromium, cadmium, titanium, nickel, palladium, and indium. Any one of the conductive materials listed above may be used independently, or any two or more of the conductive materials listed above may be used in combination. Examples of combinations of conductive materials that can be used include alloys (more specifically, aluminum alloy, stainless steel, or brass). Of the conductive materials listed above, aluminum or an aluminum alloy is preferable in terms of favorable charge mobility from the photosensitive layer 3 to the conductive substrate 2.

The shape of the conductive substrate 2 can be selected as appropriate in accordance with the structure of an image forming apparatus in which the conductive substrate 2 is to be used. The conductive substrate 2 is for example a sheet-shaped conductive substrate or a drum-shaped conductive substrate. The thickness of the conductive substrate 2 can be selected as appropriate in accordance with the shape of the conductive substrate 2.

[2. Photosensitive Layer]

The photosensitive layer 3 contains a charge generating material, a hole transport material, an electron transport material, and a binder resin. The photosensitive layer 3 may further contain an additive. No particular limitations are placed on thickness of the photosensitive layer 3 so long as the thickness thereof is sufficient to enable the photosensitive layer 3 to function as a photosensitive layer. Specifically, the photosensitive layer 3 may have a thickness of at least 5 μm and no greater than 100 μm. Preferably, the photosensitive layer 3 has a thickness of at least 10 μm and no greater than 50 μm.

The photosensitive layer 3 has a strain at break of at least 4.9% and no greater than 13.0%. The strain at break of the photosensitive layer 3 is determined from a stress-strain curve obtained by pulling the photosensitive layer 3 using a tensile tester at a rate of 5 mm/minute. Measurement thereof is carried out according to a method employed for Examples described below or a method conforming therewith. In terms of further improving abrasion resistance, the strain at break of the photosensitive layer 3 is preferably at least 5.0%, more preferably at least 6.0%, and still more preferably at least 7.0%. In terms of further improving anti-fogging performance, the strain at break of the photosensitive layer 3 is preferably at least 12.5%.

The strain at break can for example be controlled by appropriately selecting a binder resin described below and adjusting a viscosity average molecular weight of the binder resin.

A scratch resistant depth (also referred to below as a scratch depth) of the photosensitive layer 3 means a depth of a scratch created by scratching the photosensitive layer 3 under specific conditions described below. The scratch depth of the photosensitive layer 3 is measured through first to fourth steps described below using a scratching apparatus in accordance with BS K5600-5-5. The scratching apparatus includes a fixture and a scratching stylus. The scratching stylus has a semispherical sapphire tip having a diameter of 1 mm.

In the first step, the photosensitive member 1 is fixed to an upper surface of the fixture with a longitudinal direction of the photosensitive member 1 in parallel with a longitudinal direction of the fixture. In the second step, the scratching stylus is brought into vertical contact with a surface of the photosensitive layer 3. In the third step, the fixture and the photosensitive member 1 fixed to the upper surface of the fixture are caused to move by 30 mm at a rate of 30 mm/minute in the longitudinal direction of the fixture while a load of 10 g is applied from the scratching stylus to the photosensitive layer 3. Through the third step, a scratch is created on the surface of the photosensitive layer 3. In the fourth step, the greatest depth of the scratch is measured as a scratch depth.

Through the above, an overview of the measurement method of the scratch depth has been described. The measurement method of the scratch depth will be explained in detail in association with Examples described below.

The scratch depth of the photosensitive layer 3 is no greater than 0.50 μm. In terms of further improving anti-fogging performance, the scratch depth of the photosensitive layer 3 is preferably no greater than 0.40 μm, and more preferably no greater than 0.35 μm. No particular limitations are placed on the lower limit of the scratch depth of the photosensitive layer 3 so long as the photosensitive layer 3 is able to function as a photosensitive layer of the photosensitive member 1. For example, the lower limit may be 0.00 μm. However, in terms of manufacturing costs, the lower limit is preferably 0.09 μm.

The scratch depth can for example be controlled by appropriately selecting a binder resin described below and adjusting a viscosity average molecular weight of the binder resin.

The following describes a charge generating material, a hole transport material, an electron transport material, a binder resin, and an additive, which is an optional component.

(Charge Generating Material)

No particular limitations are placed on the charge generating material other than being a charge generating material that can be used in the photosensitive member. Examples of charge generating materials that can be used include phthalocyanine-based pigments, perylene-based pigments, bisazo pigments, tris-azo pigments, dithioketopyrrolopyrrole pigments, metal-free naphthalocyanine pigments, metal naphthalocyanine pigments, squaraine pigments, indigo pigments, azulenium pigments, cyanine pigments, powders of inorganic photoconductive materials (for example, selenium, selenium-tellurium, selenium-arsenic, cadmium sulfide, or amorphous silicon), pyrylium pigments, anthanthrone-based pigments, triphenyl methane-based pigments, threne-based pigments, toluidine-based pigments, pyrazoline-based pigments, and quinacridone-based pigments. Any one of the charge generating materials listed above may be used independently, or any two or more of the charge generating materials listed above may be used in combination. Examples of phthalocyanine-based pigments that can be used include metal-free phthalocyanine and metal phthalocyanine. Examples of metal phthalocyanine include titanyl phthalocyanine, hydroxygallium phthalocyanine, and chlorogallium phthalocyanine. The phthalocyanine-based pigments may be crystalline or non-crystalline. No particular limitations are placed on the crystal structure (for example, α-form, β-form, X-form, Y-form, V-form, and H-form) of the phthalocyanine-based pigments, and phthalocyanine-based pigments having various different crystal structures may be used.

An example of crystalline metal-free phthalocyanine is metal-free phthalocyanine having an X-form crystal structure (also referred to below as X-form metal-free phthalocyanine). Examples of crystalline titanyl phthalocyanine include titanyl phthalocyanines having α-form, β-form, and Y-form crystal structures (also referred to below as α-form titanyl phthalocyanine, β-form titanyl phthalocyanine, and Y-form titanyl phthalocyanine, respectively). An example of crystalline hydroxygallium phthalocyanine is hydroxygallium phthalocyanine having a V-form crystal structure.

In a situation in which the photosensitive member 1 is used in a digital optical system image forming apparatus, it is preferable to use a charge generating material that is sensitive to a range of wavelengths greater than or equal to 700 μm. An example of a charge generating material that is sensitive to a range of wavelengths greater than or equal to 700 nm is a phthalocyanine-based pigment. In particular, X-form metal-free phthalocyanine is preferable in terms of efficient charge generation. The digital optical system image forming apparatus may for example be a laser beam printer or a facsimile machine in which a light source such as a semiconductor laser is used.

In a situation in which the photosensitive member 1 is used in an image forming apparatus that employs a short-wavelength laser light source, it is preferable to use, for example, an anthanthrone-based pigment or a perylene-based pigment as a charge generating material. The wavelength of a short-wavelength laser is for example approximately 350 nm to 550 nm.

Examples of charge generating materials that can be used include phthalocyanine-based pigments represented by chemical formulae (CGM-1) to (CGM-4) shown below (also respectively referred to below as charge generating materials (CGM-1) to (CGM-4)).

(CGM-1)

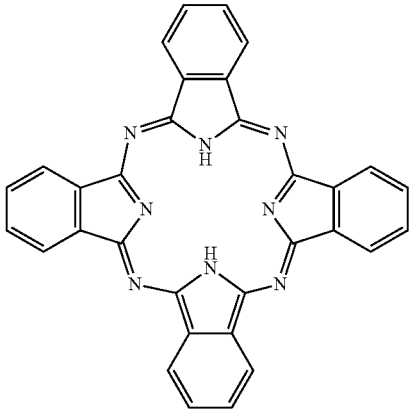

-continued (CGM-2)

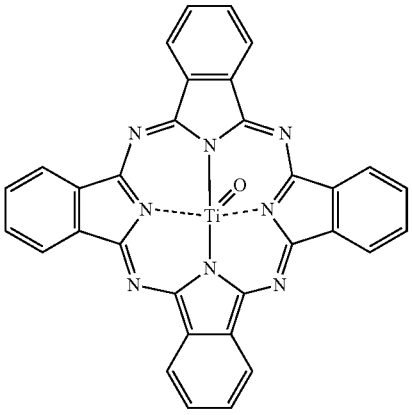

(CGM-3)

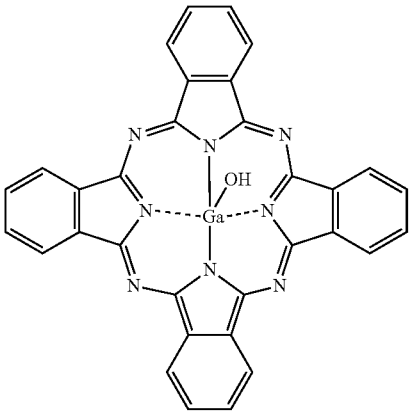

(CGM-4)

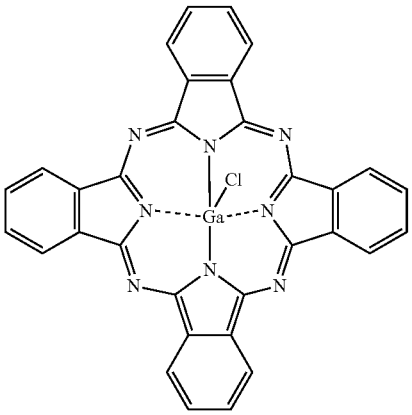

In terms of efficient charge generation, the charge generating material is preferably contained in an amount of at least 0.1 parts by mass and no greater than 50 parts h mass relative to 100 parts by mass of the binder resin, more preferably in an amount of at least 0.5 parts by mass and no greater than 30 parts by mass, and particularly preferably at least 0.5 parts by mass and no greater than 4.5 parts by mass.

(Hole Transport Material)

Examples of hole transport materials that can be used include nitrogen-containing cyclic compounds and condensed polycyclic compounds. Examples of nitrogen-containing cyclic compounds and condensed polycyclic compounds that can be used include triphenylamine derivatives, diamine derivatives (specific examples include N,N,N',N'-tetraphenylbenzidine derivatives, N,N,N',N'-tetraphenylphenylenediamine derivatives, N,N,N',N'-tetraphenylnaphtylenediamine derivatives, di(aminophenylethenyl)benzene derivatives, and N,N,N',N'-tetraphenylphenanthrylenediamine derivatives), oxadiazole-based compounds (specific examples include 2,5-di(4-methylaminophenyl)-1,3,4-oxadiazole), styryl-based compounds (specific example include 9-(4-diethylaminostyryl)anthracene), carbazole-based compounds (specific examples include polyvinyl carbazole), organic polysilane compounds, pyrazoline-based compounds (specific examples include 1-phenyl-3-(p-dimethylaminophenyl)pyrazoline), hydrazone-based compounds, indole-based compounds, oxazole-based compounds, isoxazole-based compounds, triazole-based compounds, thiadiazole-based compounds, imidazole-based compounds, pyrazole-based compounds, and triazole-based compounds. Any one of the hole transport materials listed above may be used independently, or any two or more of the hole transport materials listed above may be used in combination.

Of the hole transport materials listed above, a compound represented by general formula (HTM) shown below (also referred to below as a hole transport material (HTM)) is preferable in terms of further improving abrasion resistance.

(HTM)

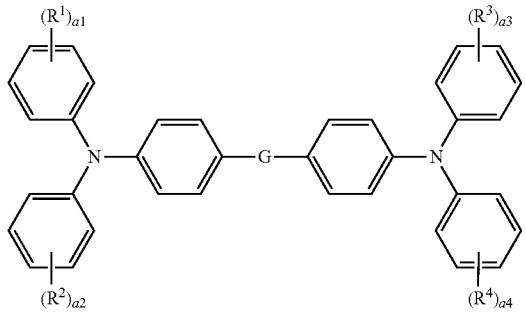

In general formula (HTM), $R^1$, $R^2$, $R^3$, and $R^4$ each represent, independently of one another, an alkyl group having a carbon number of at least 1 and no greater than 6 or an alkoxy group having a carbon number of at least 1 and no greater than 6. a1, a2, a3, and a4 each represent, independently of one another, an integer of at least 0 and no greater than 5. a1, a2, a3, and a4 do not all simultaneously represent 0. When a1 represents an integer of at least 2 and no greater than 5, chemical groups $R^1$ may be the same as or different from one another. When a2 represents an integer of at least 2 and no greater than 5, chemical groups $R^2$ may be the same as or different from one another. When a3 represents an integer of at least 2 and no greater than 5, chemical groups $R^3$ may be the same as or different from one another. When a4 represents an integer of at least 2 and no greater than 5, chemical groups $R^4$ may be the same as or different from one another. G represents a single bond or a p-phenylene group.

In general formula (HTM), $R^1$, $R^2$, $R^3$, and $R^4$ each preferably represent an alkoxy group having a carbon number of at least 1 and no greater than 6, and more preferably a methoxy group, in terms of further improving abrasion resistance. In terms of further improving abrasion resistance, a1, a2, a3, and a4 each preferably represent, independently of one another, 0 or 1. In terms of further improving abrasion resistance, G preferably represents a p-phenylene group.

In terms of further improving abrasion resistance, the hole transport material (HTM) is preferably a compound represented by chemical formula (H-1) shown below (also referred to below as a hole transport material (H-1)).

(H-1)

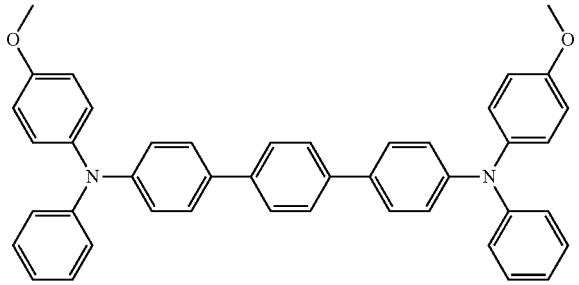

In terms of efficient hole transport, the hole transport material is preferably contained in an amount of at least 10 parts by mass and no greater than 200 parts by mass relative to 100 parts by mass of the binder resin, and more preferably in an amount of at least 10 parts by mass and no greater than 100 parts by mass.

(Electron Transport Material)

Examples of electron transport materials that can be used include quinone-based compounds, diimide-based compounds, hydrazone-based compounds, malononitrile-based compounds, thiopyran-based compounds, trinitrothioxanthone-based compounds, 3,4,5,7-tetranitro-9-fluorenone-based compounds, dinitroanthracene-based compounds, dinitroacridine-based compounds, tetracyanoethylene, 2,4,8-trinitrothioxanthone, dinitrobenzene, dinitroacridine, succinic anhydride, maleic anhydride, and dibromomaleic anhydride. Examples of quinone-based compounds that can be used include diphenoquinone-based compounds, azoquinone-based compounds, anthraquinone-based compounds, naphthoquinone-based compounds, nitroanthraquinone-based compounds, and dinitroanthraquinone-based compounds. Any one of the electron transport materials listed above may be used independently, or any two or more of the electron transport materials listed above may be used in combination.

Of the electron transport materials listed above, a compound represented by general formula (ETM) shown below is preferable, and a compound represented by chemical formula (E-1) shown below (also referred to below as an electron transport material (E-1)) is more preferable, in terms of efficient electron transport.

(ETM)

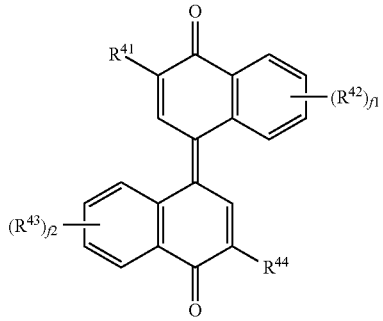

In general formula (ETM), $R^{41}$ and $R^{44}$ each represent, independently of one another, a hydrogen atom or an alkyl group having a carbon number of at least 1 and no greater than 6. $R^{42}$ and $R^{43}$ each represent, independently of one another, an alkyl group having a carbon number of at least 1 and no greater than 6. f1 and f2 each represent, independently of one another, an integer of at least 0 and no greater than 4. When f1 represents an integer of at least 2 and no greater than 4, chemical groups $R^{42}$ may be the same as or different from one another. When f2 represents an integer of at least 2 and no greater than 4, chemical groups $R^{43}$ may be the same as or different from one another.

(E-1)

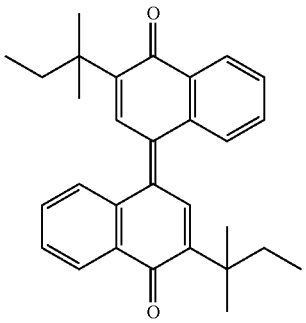

In terms of efficient electron transport, the electron transport material is preferably contained in an amount of at least 5 parts by mass and no greater than 100 parts by mass relative to 100 parts by mass of the binder resin, and more preferably in an amount of at least 10 parts by mass and no greater than 80 parts by mass.

(Binder Resin)

Examples of binder resins that can be used include thermoplastic resins, thermosetting resins, and photocurable resins. Examples of thermoplastic resins that can be used include polycarbonate resins, polyarylate resins, styrene-butadiene copolymers, styrene-aclonitrile copolymers, styrene-maleic acid copolymers, acrylic acid polymers, styrene-acrylic acid copolymers, polyethylene resins, ethylene-vinyl acetate copolymers, chlorinated polyethylene resins, polyvinyl chloride resins, polypropylene resins, ionomer resins, vinyl chloride-vinyl acetate copolymers, alkyd resins, polyamide resins, urethane resins, polysulfone resins, diallyl phthalate resins, ketone resins, polyvinyl butyral resins, polyester resins, and polyether resins. Examples of thermosetting resins that can be used include silicone resins, epoxy resins, phenolic resins, urea resins, and melamine resins. Examples of photocurable resins that can be used include epoxy-acrylic acid-based resins (acrylic acid adducts of epoxy compounds) and urethane-acrylic acid-based copolymers (acrylic acid adducts of urethane compounds). Any one of the binder resins listed above may be used independently, or any two or more of the binder resins listed above may be used in combination.

Of the binder resins listed above, a polyarylate resin is preferable, and a polyarylate resin represented by general formula (1) shown below (also referred to below as a polyarylate resin (1)) is more preferable, in terms of further improving abrasion resistance and anti-fogging performance.

(1)

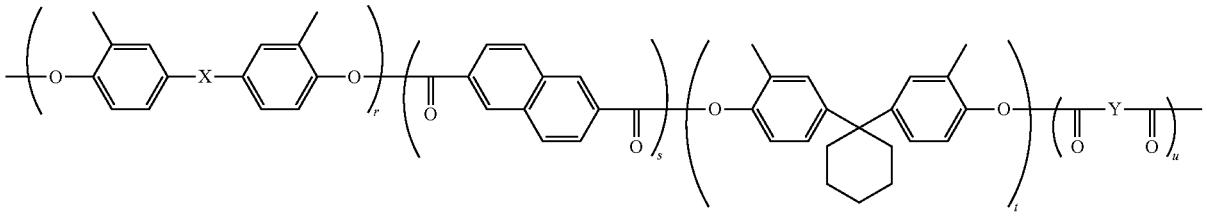

In general formula (1), r, s, t, and u each represent, independently of one another, a number greater than or equal to 0. r+s+t+u=100. r+t=s+u. r/(r+t) is at least 0.00 and no greater than 0.90. s/(s+u) is at least 0.00 and no greater than 0.90. X is a divalent group represented by chemical formula (1A) or (1B) shown below Y is a divalent group represented by chemical formula (2A) or (2B) shown below.

(1A)

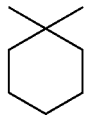

(1B)

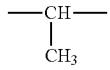

(2A)

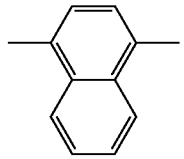

(2B)

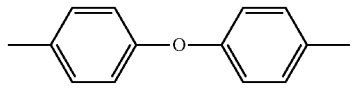

In terms of further improving abrasion resistance and anti-fogging performance, X in general formula (1) is preferably a divalent group represented by chemical formula (1A). In terms of further improving abrasion resistance and anti-fogging performance, Y is preferably a divalent group represented by chemical formula (2A).

In terms of further improving abrasion resistance and anti-fogging performance, r/(r+t) in general formula (1) is preferably at least 0.10 and no greater than 0.70, and more preferably at least 0.30 and no greater than 0.70. In terms of further improving abrasion resistance and anti-fogging performance, s/(s+u) is preferably at least 0.10 and no greater than 0.70, and more preferably at least 0.30 and no greater than 0.70.

The polyarylate resin (1) for example has a repeating unit represented by general formula (1-5) shown below (also referred to below as a repeating unit (1-5)), a repeating unit represented by chemical formula (1-6) shown below (also referred to below as a repeating unit (1-6)), a repeating unit represented by chemical formula (1-7) shown below (also referred to below as a repeating unit (1-7)), and a repeating unit represented by general formula (1-8) shown below (also referred to below as a repeating unit (1-8)).

(1-5)

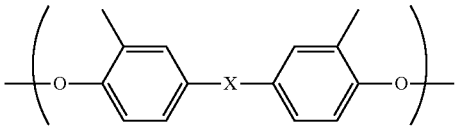

(1-6)

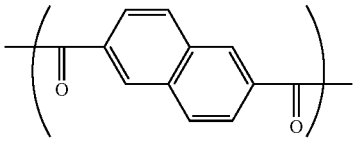

(1-7)

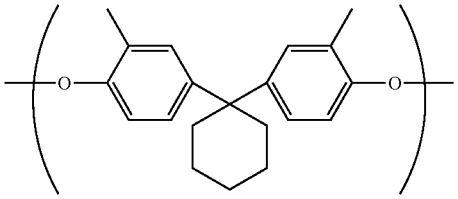

(1-8)

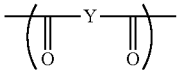

X in general formula (1-5) is the same as defined for X in general formula (1) Y in general formula (1-8) is the same as defined for Y in general formula (1).

The polyarylate resin (1) may have another repeating unit in addition to the repeating units (1-5) to (1-8). A ratio (mole fraction) of a sum of the amounts by mole of the repeating units (1-5) to (1-8) relative to the total amount by mole of all the repeating units included in the polyarylate resin (1) is preferably at least 0.80, more preferably at least 0.90, and still more preferably 1.00.

No particular limitations are placed on the sequence of the repeating units (1-5) to (1-8) in the polyarylate resin (1) so long as a repeating unit derived from an aromatic diol and a repeating unit derived from an aromatic dicarboxylic acid are adjacent to one another. For example, the repeating unit (1-5) is adjacent to and bonded to the repeating unit (1-6) or the repeating unit (1-8). Likewise, the repeating unit (1-7) is adjacent to and bonded to the repeating unit (1-6) or the repeating unit (1-8).

Or in general formula (1) represents a percentage of the number of the repeating units (1-5) relative to a sum of the number of the repeating units (1-5), the number of the repeating units (1-6), the number of the repeating units (1-7), and the number of the repeating units (1-8) in the polyarylate resin (1). s represents a percentage of the number of the repeating units (1-6) relative to the sum of the number of the repeating units (1-5), the number of the repeating units (1-6), the number of the repeating units (1-7), and the number of the repeating units (1-8) in the polyarylate resin (1). t represents a percentage of the number of the repeating units (1-7) relative to the sum of the number of the repeating units (1-5), the number of the repeating units (1-6), the number of the repeating units (1-7), and the number of the repeating units (1-8) in the polyarylate resin (1). u represents a percentage of the number of the repeating units (1-8) relative to the sum of the number of the repeating units (1-5), the number of the repeating units (1-6), the number of the repeating units (1-7), and the number of the repeating units (1-8) in the polyarylate resin (1). Each of r, s, t, and u is not a value obtained from one resin chain but a number average obtained from all molecules of the polyarylate resin (1) (a plurality of resin chains) that can be contained in the photosensitive layer 3. Each of r, s, t, and u can be for example calculated from a $^{1}$H-NMR spectrum of the polyarylate resin (1) measured using a proton nuclear magnetic resonance spectrometer.

Examples of the polyarylate resin (1) include polyarylate resins represented by chemical formulae (R-1) to (R-4) (also respectively referred to below as polyarylate resins (R-1) to (R-4)).

(R-1)

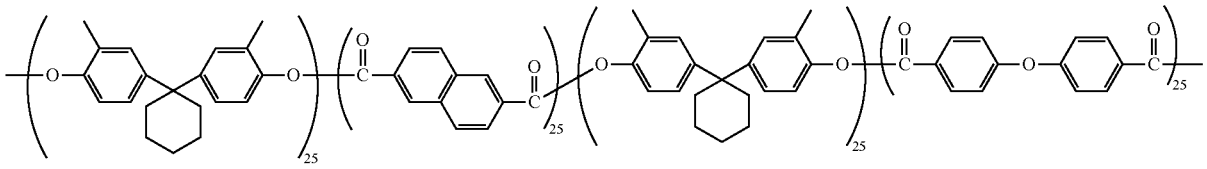

(R-2)

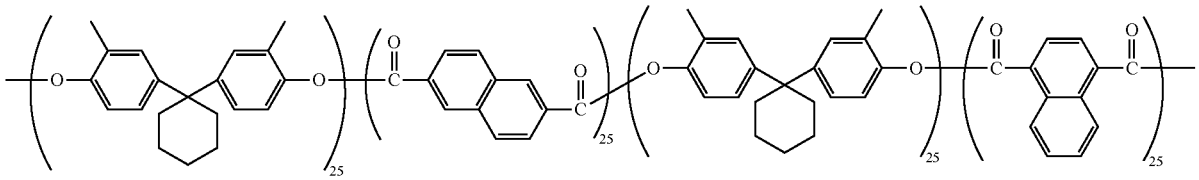

-continued (R-3)

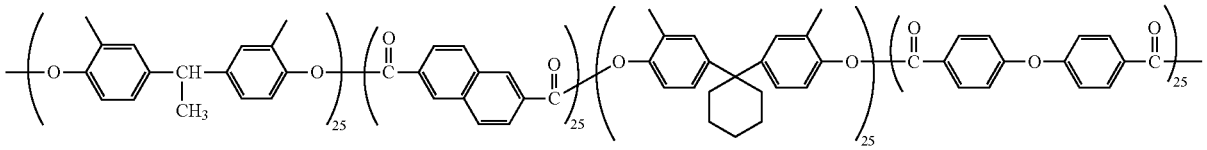

(R-4)

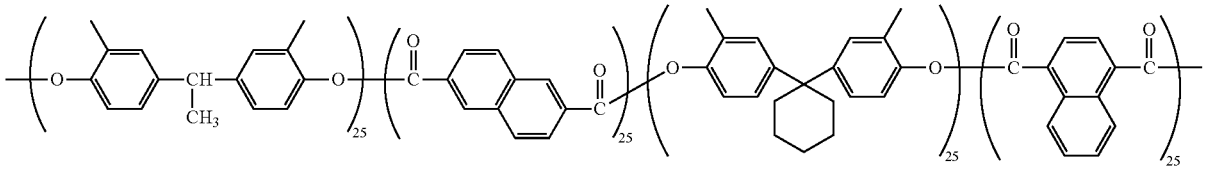

In terms of further improving anti-fogging performance, the polyarylate resin (1) is preferably the polyarylate resin (R-2) or the polyarylate resin (R-4). More preferably, the polyarylate resin (1) is the polyarylate resin (R-2).

No particular limitations are placed on a production method of the binder resin. Examples of production methods that can be employed to produce the polyarylate resin (1) to be used as the binder resin include a method involving polycondensation of an aromatic diol for forming a repeating unit and an aromatic dicarboxylic acid for forming a repeating unit. No particular limitations are placed on a method of polycondensation, and any known synthesis method (specific examples include solution polymerization, melt polymerization, and interfacial polymerization) can be employed.

The aromatic dicarboxylic acid that is used in production of the polyarylate resin (1) has two carboxyl groups and is represented by chemical formula (1-9) shown below or general formula (1-10) shown below. Y in general formula (1-10) is the same as defined for Y in general formula (1).

(1-9)

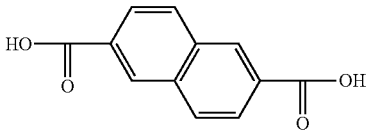

(1-10)

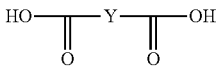

Derivatives of the aromatic dicarboxylic acid such as diacid dichlorides, dimethyl esters, and diethyl esters may alternatively be used. Furthermore, the aromatic dicarboxylic acid that is used in the polycondensation may include an aromatic dicarboxylic acid other than the aromatic dicarboxylic acids represented by chemical formula (1-9) and general formula (1-10).

The aromatic diol has two phenolic hydroxyl groups and is represented by general formula (1-11) shown below or chemical formula (1-12) shown below. X in general formula (1-11) is the same as defined for X in general formula (1).

(1-11)

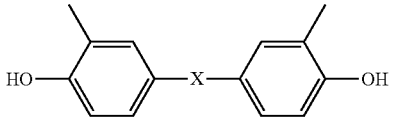

(1-12)

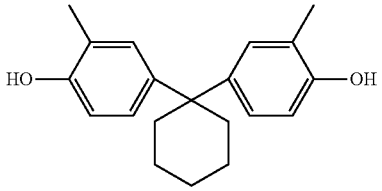

Derivatives of the aromatic diol such as diacetates may be used for synthesis of the polyarylate resin (1). Furthermore, the aromatic diol that is used in the polycondensation may include an aromatic diol other than the aromatic diols represented by general formula (1-11) and chemical formula (1-12).

The binder resin has a viscosity average molecular weight of at least 25,000 and no greater than 50,000. In terms of further improving abrasion resistance and anti-fogging performance, the viscosity average molecular weight is preferably at least 30,000. In terms of further improving anti-fogging performance, the viscosity average molecular weight is preferably no greater than 46,000. The viscosity average molecular weight can for example be controlled by adjusting an amount of a chain terminator that is used in production of the binder resin. The viscosity average molecular weight is measured according to a method employed for Examples described below or a method conforming therewith.

(Additive)

An additive may be added as an optional component. Examples of additives that can be used include antidegradants (specific examples include antioxidants, radical scavengers, quenchers, and ultraviolet absorbing agents), softeners, surface modifiers, extenders, thickeners, dispersion stabilizers, waxes, donors, surfactants, and leveling agents. Any one of the additives listed above may be used independently, or any two or more of the additives listed above may be used in combination.

Examples of antioxidants that can be used include hindered phenol compounds, hindered amine compounds, thioether compounds, and phosphite compounds. Of the antioxidants listed above, hindered phenol compounds and hindered amine compounds are preferable.

(Material Combination)

In terms of further improving abrasion resistance and anti-fogging performance, it is preferable that the hole transport material in the photosensitive layer 3 is the hole transport material (H-1), and the binder resin in the photosensitive layer 3 is at least one selected from the polyarylate resins (R-1) to (R-4). In terms of further improving abrasion resistance and anti-fogging performance, it is more preferable that the hole transport material in the photosensitive layer 3 is the hole transport material (H-1), and the binder resin in the photosensitive layer 3 is the polyarylate resin (R-2).

[3. Intermediate Layer]

As described above, the photosensitive member 1 according to the present embodiment may have the intermediate layer 4 (for example, an undercoat layer). The intermediate layer 4 for example contains inorganic particles and a resin that is used for the intermediate layer (intermediate layer resin). Provision of the intermediate layer 4 can facilitate flow of current generated when the photosensitive member 1 is exposed to light and inhibit increasing resistance, while also maintaining insulation to a sufficient degree so as to inhibit occurrence of leakage current.

Examples of inorganic particles that can be used include particles of metals (specific examples include aluminum, iron, and copper), metal oxides (specific examples include titanium oxide, alumina, zirconium oxide, tin oxide, and zinc oxide), and non-metal oxides (specific examples include silica). Any one type of the inorganic particles listed above may be used independently, or any two or more types of the inorganic particles listed above may be used in combination. The inorganic particles may be surface-treated.

No particular limitations are placed on the intermediate layer resin other than being a resin that can be used for forming the intermediate layer.

[4. Photosensitive Member Production Method]

The following describes a production method of the photosensitive member 1. The production method of the photosensitive member 1 for example includes a photosensitive layer formation process. In the photosensitive layer formation process, an application liquid for formation of the photosensitive layer 3 (also referred to below as an application liquid for photosensitive layer formation) is prepared. Next, the application liquid for photosensitive layer formation is applied onto the conductive substrate 2. Next, drying is performed by an appropriate method to remove at least a portion of a solvent in the applied application liquid for photosensitive layer formation. Thus, the photosensitive layer 3 is formed. The application liquid for photosensitive layer formation for example contains a charge generating material, a hole transport material, an electron transport material, a binder resin, and a solvent. The application liquid for photosensitive layer formation is prepared by dissolving or dispersing the charge generating material, the hole transport material, the electron transport material, and the binder resin in the solvent. Various additives may optionally be added to the application liquid for photosensitive layer formation.

The following describes the photosensitive layer formation process in detail. No particular laminations are placed on the solvent contained in the application liquid for photosensitive layer formation other than that components of the application liquid for photosensitive layer formation should be soluble or dispersible in the solvent. Examples of solvents that can be used include alcohols (specific examples include methanol, ethanol, isopropanol, and butanol), aliphatic hydrocarbons (specific examples include n-hexane, octane, and cyclohexane), aromatic hydrocarbons (specific examples include benzene, toluene, and xylene), halogenated hydrocarbons (specific examples include dichloromethane, dichloroethane, carbon tetrachloride, and chlorobenzene), ethers (specific examples include dimethyl ether, diethyl ether, tetrahydrofuran, ethylene glycol dimethyl ether, and diethylene glycol dimethyl ether), ketones (specific examples include acetone, methyl ethyl ketone, and cyclohexanone), esters (specific examples include ethyl acetate and methyl acetate), dimethyl formaldehyde, dimethyl formamide, and dimethyl sulfoxide. Any one of the solvents listed above may be used independently, or any two or more of the solvents listed above may be used in combination. Of the solvents listed above, a non-halogenated solvent is preferably used.

The application liquid for photosensitive layer formation is prepared by mixing the components to disperse the components in the solvent. Mixing or dispersion can for example be performed using a bead mill, a roll mill, a ball mill, an attritor, a paint shaker, or an ultrasonic disperser.

The application liquid for photosensitive layer formation may for example contain a surfactant in order to improve dispersibility of the components.

No particular limitations are placed on the method by which the application liquid for photosensitive layer formation is applied so long as the method enables uniform application of the application liquid for photosensitive layer formation. Examples of application methods that can be used include dip coating, spray coating, spin coating, and bar coating.

No particular limitations are placed on the method by which at least a portion of the solvent in the application liquid for photosensitive layer formation is removed other than being a method that enables evaporation of at least a portion of the solvent in the application liquid for photosensitive layer formation. Examples of methods that can be used to remove a portion of the solvent include heating, pressure reduction, and a combination of heating and pressure reduction. One specific example of a method involves heat treatment (hot-air drying) using a high-temperature dryer or a reduced pressure dryer. The heat treatment is for example performed for at least 3 minutes and no greater than 120 minutes at a temperature of at least 40° C. and no greater than 150° C.

Note that the production method of the photosensitive member 1 may further include a process of forming the intermediate layer 4 as necessary. The process of forming the intermediate layer 4 can be carried out by a method selected appropriately from known methods.

The photosensitive member according to the present embodiment described above is excellent in abrasion resistance and anti-fogging performance, and can therefore be favorably used in various image forming apparatuses.

Second Embodiment: Image Forming Apparatus

The following describes an image forming apparatus according to a second embodiment. The image forming apparatus according to the second embodiment includes an image bearing member, a charger, a light exposure section, a development section, and a transfer section. The image bearing member is the photosensitive member according to the first embodiment described above. The charger charges a surface of the image bearing member. The charger has a positive charging polarity. The light exposure section exposes the charged surface of the image bearing member to light to form an electrostatic latent image on the surface of the image bearing member. The development section develops the electrostatic latent image into a toner image. The transfer section transfers the toner image from the image bearing member to a transfer target while bringing the transfer target into contact with the surface of the image bearing member.

The image forming apparatus according to the second embodiment can inhibit image defects from occurring. The reason for the above is thought to be as follows. The image forming apparatus according to the second embodiment includes the photosensitive member according to the first embodiment as an image bearing member. The photosensitive member according to the first embodiment is excellent in abrasion resistance and anti-fogging performance. The image forming apparatus according to the second embodiment can therefore inhibit image defects (specific examples include fogging) from occurring.

Figure 4:
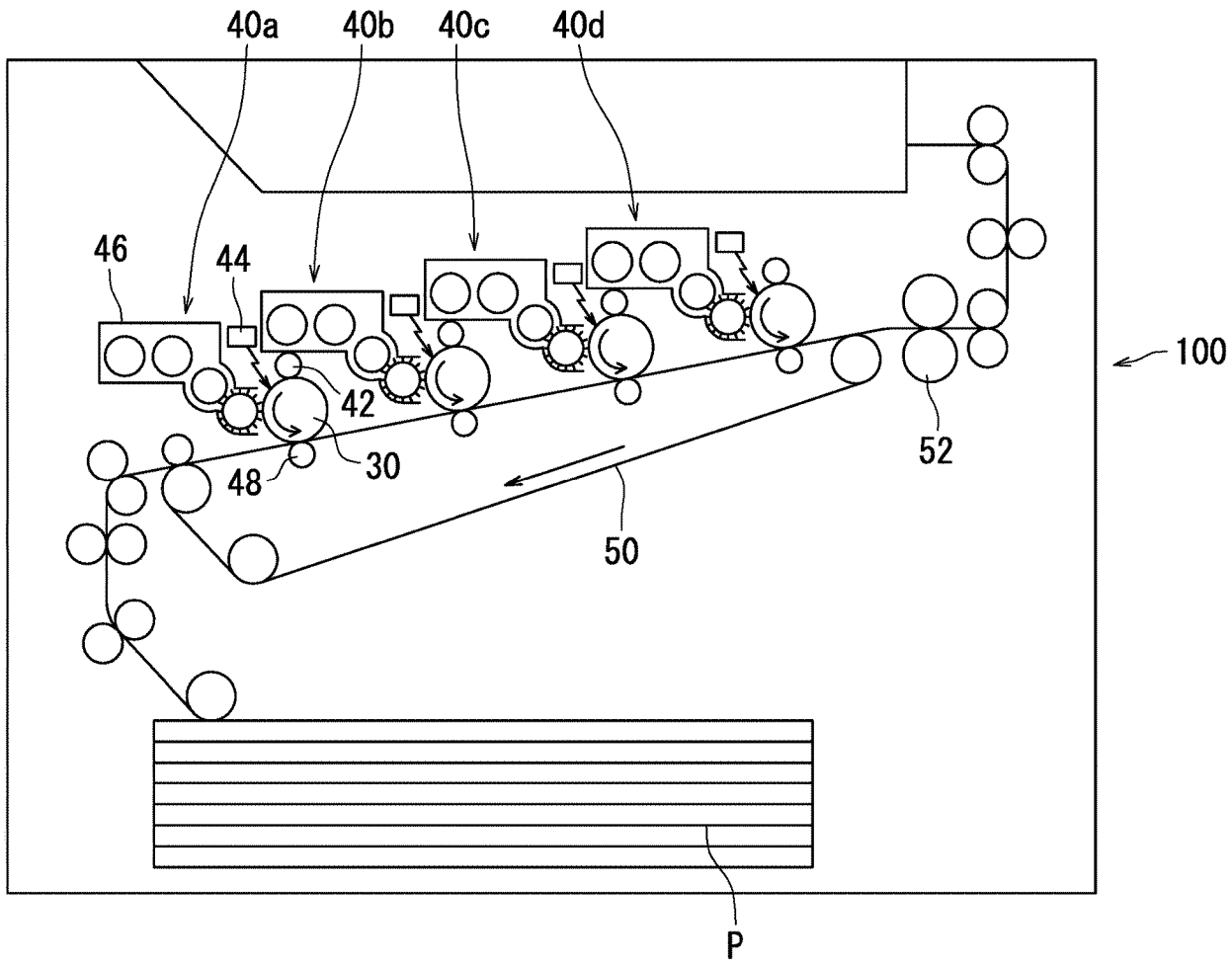
FIG. 4 is a diagram illustrating an example of an image forming apparatus according to a second embodiment of the present disclosure.

The following describes a tandem color image forming apparatus as an example of the image forming apparatus according to the second embodiment with reference to FIG. 4.

An image forming apparatus 100 illustrated in FIG. 4 adopts a direct transfer process. Typically, a recording medium serving as a transfer target comes in contact with an image bearing member in an image forming apparatus adopting the direct transfer process. As a result, minute matter from the recording medium is likely to adhere to a surface of the image bearing member and cause an image defect. However, the image forming apparatus 100, which is an example of the second embodiment, includes the photosensitive member according to the first embodiment as an image bearing member 30. The photosensitive member according to the first embodiment is excellent in anti-fogging performance. Accordingly, as long as the image forming apparatus 100 includes the photosensitive member according to the first embodiment as the image bearing member 30, it is possible to inhibit image defects from occurring even if the image forming apparatus 100 adopts the direct transfer process.

The image forming apparatus 100 includes image formation units 40*a*, 40*b*, 40*c*, and 40*d*, a transfer belt 50, and a fixing section 52. Hereinafter, the image formation units 40*a*, 40*b*, 40*c*, and 40*d* are each referred to as an image formation unit 40 unless they need to be distinguished from one another.

The image formation unit 40 includes the image bearing member 30, a charger 42, a light exposure section 44, a development section 46, and a transfer section 48. The image bearing member 30 is located at a central position in the image formation unit 40. The image bearing member 30 is rotatable in an arrow direction (counter clockwise). The charger 42, the light exposure section 44, the development section 46, and the transfer section 48 are located around the image bearing member 30 in order from upstream in a rotation direction of the image bearing member 30 relative to the charger 42 as a reference point. The image formation unit 40 may further include either or both of a cleaning section (not shown) and a static eliminating section (not shown).

The image formation units 40*a* to 40*d* respectively superimpose toner images of a plurality of colors (for example, black, cyan, magenta, and yellow) order on a recording medium P (transfer target) on the transfer belt 50.

The charger 42 is a charging roller. The charging roller charges a surface of the image bearing member 30 while in contact with the surface of the image bearing member 30. Typically, image defects easily occur in an image forming apparatus including a charging roller. However, the image forming apparatus 100 includes the photosensitive member according to the first embodiment as the image bearing member 30. The photosensitive member according to the first embodiment is excellent in abrasion resistance and anti-fogging performance. It is therefore possible to inhibit image defects from occurring even if the image forming apparatus 100 includes a charging roller as the charger 42. As described above, the image forming apparatus 100, which is an example of the second embodiment, adopts a contact charging process. Another example of the contact charger is a charging brush. Note that the charger may be a non-contact charger. Examples of the non-contact charger include a corotron charger or a scorotron charger.

No particular limitations are placed on the voltage that is applied by the charger 42. The voltage that is applied by the charger 42 is for example a direct current voltage, an alternating current voltage, or a composite voltage (of an alternating current voltage superimposed on a direct current voltage), among which a direct current voltage is preferable. The direct current voltage is advantageous as described below compared to an alternating current voltage and a composite voltage. In a configuration in which the charger 42 only applies a direct current voltage, the value of voltage applied to the image bearing member 30 is constant, and therefore it is easy to uniformly charge the surface of the image bearing member 30 to a specified potential. The amount of abrasion of the photosensitive layer tends to be smaller in a configuration in which the charger 42 only applies a direct current voltage. As a result, favorable images can be formed.

The light exposure section 44 exposes the charged surface of the image bearing member 30 to light. As a result, an electrostatic latent image is formed on the surface of the image bearing member 30. The electrostatic latent image is formed based on image data input into the image forming apparatus 100.

The development section 46 supplies toner to the surface of the image bearing member 30 to develop the electrostatic latent image into a toner image. The development section 46 may develop the electrostatic latent image into a toner image while in contact with the surface of the image bearing member 30 (contact development process). Typically, image defects due to fogging easily occur in an image forming apparatus adopting the contact development process. However, the image forming apparatus 100 includes the photosensitive member according to the first embodiment as the image bearing member 30. The photosensitive member according to the first embodiment is excellent in anti-fogging performance. As long as the image forming apparatus 100 includes such a photosensitive member, it is possible to inhibit image defects due to fogging from occurring even if the image forming apparatus 100 adopts the contact development process.

The development section 46 is capable of cleaning the surface of the image bearing member 30. That is, the image forming apparatus 100 may adopt a cleaner-less process, which is a process without a cleaner. According to this configuration, the development section 46 is capable of removing residual matter on the surface of the image bearing member 30. A typical image forming apparatus including a cleaning section (for example, a cleaning blade) and an image bearing member scrapes away residual matter on a surface of the image bearing member using the cleaning section. However, the image forming apparatus adopting the cleaner-less process does not scrape away residual matter on the surface of the image bearing member. The image forming apparatus adopting the cleaner-less process therefore tends to leave the residual matter on the surface of the image bearing member. However, the image forming apparatus 100 includes the photosensitive member according to the first embodiment, which is excellent in anti-fogging performance, as the image bearing member 30. As long as the image forming apparatus 100 includes such a photosensitive member, residual matter, particularly minute matter (for example, paper dust) from the recording medium P, tends not to be left on the surface of the photosensitive member even if the image forming apparatus 100 adopts the cleanerless process. As a result, the image forming apparatus 100 is capable of inhibiting image defects (for example, fogging) from occurring.

In order that the development section 46 efficiently cleans the surface of the image bearing member 30 as well as performing development, the following conditions (a) and (b) are preferably satisfied.

Condition (a): A contact development process is adopted, and a peripheral speed (rotation speed) of the image bearing member 30 and a peripheral speed (rotation speed) of the development section 46 are different.

Condition (b): A surface potential of the image bearing member 30 and a potential of development bias satisfy relation (b-1) and relation (b-2) shown below.

0 (V)<Potential (V) of development bias<Surface potential (V) of non-exposed region of image bearing member 30) (b-1)

Potential (V) of development bias>Surface potential (V) of exposed region of image bearing member 30>0 (V) (b-2)

When the condition (a) is satisfied, that is, in a configuration in which the contact development process is adopted, and the peripheral speed of the image bearing member 30 and the peripheral speed of the development section 46 are different, the surface of the image bearing member 30 is in contact with the development section 46, and residual matter on the surface of the image bearing member 30 is removed by rubbing against the development section 46. Preferably, the peripheral speed of the development section 46 is greater than the peripheral speed of the image bearing member 30.

The condition (b) is on the assumption that a reversal development process is adopted. Preferably, in order to improve electrical characteristics of the image bearing member 30 that has a positive charging polarity, all of the charging polarity of the toner, the surface potential of the non-exposed region of the image bearing member 30, the surface potential of the exposed region of the image bearing member 30, and the potential of the development bias are of positive polarity. Note that the surface potential of the non-exposed region of the image bearing member 30 and the surface potential of the exposed region of the image bearing member 30 are measured after toner image transfer from the image bearing member 30 to the recording medium P by the transfer section 48 and before charging of the surface of the image bearing member 30 by the charger 42.

When the relation (b-1) of the condition (b) is satisfied, an electrostatic repulsion between remaining toner (also referred to below as residual toner) on the image bearing member 30 and the non-exposed region of the image bearing member 30 is greater than an electrostatic repulsion between the residual toner and the development section 46. As a result, the residual toner in the non-exposed region of the image bearing member 30 moves from the surface of the image bearing member 30 to the development section 46 to be collected.

When relation (b-2) of the condition (b) is satisfied, an electrostatic repulsion between the residual toner and the exposed region of the image bearing member 30 is smaller than an electrostatic repulsion between the residual toner and the development section 46. As a result, the residual toner on the exposed region of the image bearing member 30 is kept on the surface of the image bearing member 30. The toner kept in the exposed region of the image bearing member 30 is then used for image formation.

The transfer belt 50 conveys the recording medium P to a location between the image bearing member 30 and the transfer section 48. The transfer belt 50 is an endless belt. The transfer belt 50 is rotatable in an arrow direction (clockwise).

After the toner image is formed through development by the development section 46, the transfer section 48 transfers the toner image from the surface of the image bearing member 30 to the recording medium P. The toner image is transferred from the image bearing member 30 to the recording medium P while the image bearing member 30 is in contact with the recording medium P. The transfer section 48 is for example a transfer roller.

The fixing section 52 applies either or both of heat and pressure to the unfixed toner image transferred to the recording medium P by the transfer section 48. The fixing section 52 is for example either or both of a heating roller and a pressure roller. The toner image is fixed to the recording medium P through application of either or both of heat and pressure to the toner image. As a result, an image is formed on the recording medium P.

An example of the image forming apparatus according to the second embodiment has been described above. However, the image forming apparatus according to the second embodiment is not limited to the image forming apparatus 100 described above. For example, the image forming apparatus according to the second embodiment is not limited to the above-described tandem image forming apparatus 100 and may alternatively be a rotary image forming apparatus. Furthermore, the image forming apparatus according to the second embodiment may be a monochrome image forming apparatus. In this case, for example, it is only necessary that the image forming apparatus includes at least one image formation unit. The image forming apparatus according to the second embodiment may adopt an intermediate transfer process. In a configuration in which the image forming apparatus according to the second embodiment adopts an intermediate transfer process, the transfer target is an intermediate transfer belt.

Third Embodiment: Process Cartridge

A process cartridge according to a third embodiment includes the photosensitive member according to the first embodiment as an image bearing member. The following describes an example of the process cartridge according to the third embodiment with reference to FIG. 4.

The process cartridge according to the third embodiment is for example equivalent to each of the image formation units 40*a* to 40*d* (FIG. 4) Each of the process cartridges includes a unitized configuration. The unitized configuration includes the image bearing member 30. The unitized configuration may include, in addition to the image bearing member 30, at least one selected from the group consisting of the charger 42, the light exposure section 44, the development section 46, and the transfer section 48. The process cartridge may further include either or both of a cleaning section (not shown) and a static eliminating section (not shown). The process cartridge is for example designed to be freely attachable to and detachable from the image forming apparatus 100. Accordingly, the process cartridge is easy to handle and can be easily and quickly replaced, together with the image bearing member 30, when properties such as sensitivity of the image bearing member 30 deteriorate.

The process cartridge according to the third embodiment described above includes the photosensitive member according to the first embodiment as an image bearing member, and thus is capable of inhibiting image defects from occurring.

EXAMPLES

The following provides more specific description of the present disclosure through use of Examples. However, the present disclosure is not in any way limited by the scope of the Examples.

<Materials Used in Examples and Comparative Examples>

A charge generating material, hole transport materials, an electron transport material, and binder resins described below were prepared as materials for production of single-layer photosensitive members.

[Charge Generating Material]

The charge generating material (CGM-1) described in association with the first embodiment was prepared. The charge generating material (CGM-1) was metal-free phthalocyanine represented by chemical formula (CGM-1) having an X-form crystal structure. That is, the charge generating material (CGM-1) was X-form metal-free phthalocymine.

[Hole Transport Material]

The hole transport material (H-1) described in association with the first embodiment was prepared. Furthermore, a hole transport material (H-2) was also prepared. The hole transport material (H-2) is a hole transport material represented by chemical formula (H-2) shown below.

(H-2)

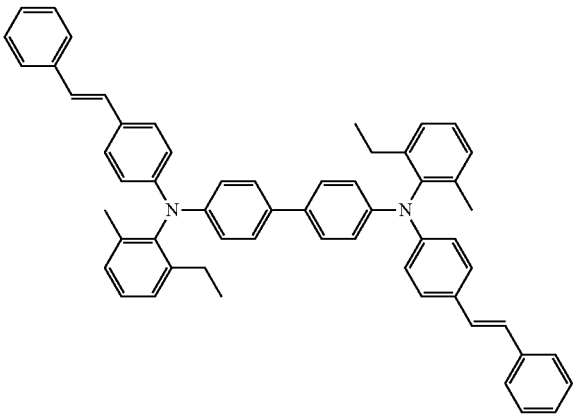

[Electron Transport Material]

The electron transport material (E-1) described in association with the first embodiment was prepared.

[Binder Resin]

The polyarylate resins (R-1) to (R-4) described in association with the first embodiment were synthesized according to a method described below. Furthermore, a polyarylate resin (R-5) and a polycarbonate resin (R-6) were prepared. The polyarylate resin (R-5) and the polycarbonate resin (R-6) are resins that are respectively represented by chemical formulae (R-5) and (R-6) shown below.

(R-5)

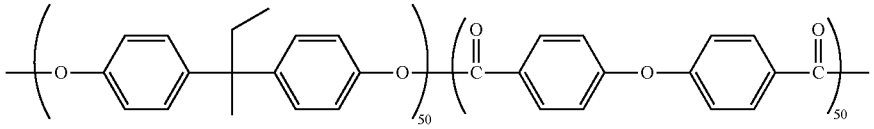

(R-6)

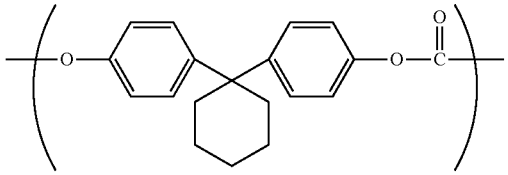

[Synthesis of Polyarylate Resins (R-1) to (R-4)]

The polyarylate resins (R-1) to (R-4) were synthesized according to a method described below. Five polyarylate resins (R-1) each having a different viscosity average molecular weight were synthesized as the polyarylate resin (R-1). The polyarylate resin (R-1) having a viscosity average molecular weight of 25,200 is referred to below as a polyatylate resin (R-1-1). The polyarylate resin (R-1) having a viscosity average molecular weight of 35,200 is referred to below as a polyarylate resin (R-1-2). The polyatylate resin (R-1) having a viscosity average molecular weight of 45,100 is referred to below as a polyarylate resin (R-1-3). The polyarylate resin (R-1) having a viscosity average molecular weight of 17,900 is referred to below as a polyarylate resin (R-1-4). The polyarylate resin (R-1) having a viscosity average molecular weight of 53,100 is referred to below as a polyarylate resin (R-1-5).

(Synthesis of Polyarylate Resin (R-1-1))

A three-necked flask having a capacity of 1 L and equipped with a thermometer, a three-way cock, and a dripping funnel was used as a reaction vessel. Into the reaction vessel, 12.2 g (41.3 mmol) of 1,1-bis(4-hydroxy-3-methylphenyl)cyclohexane as an aromatic diol. 0.37 g (2.45 mmol) of t-butylphenol as a chain terminator. 3.9 g (98 mmol) of sodium hydroxide, and 0.12 g (0.38 mmol) of benzyltributylammonium chloride were added. Next, the reaction vessel was purged with argon. Next, 600 mL of water was added into the reaction vessel. The internal temperature of the reaction vessel was kept at 20° C., and the reaction vessel contents were stirred for 1 hour. Next, the reaction vessel contents were cooled to reduce the internal temperature of the reaction vessel to 10° C. Thus, an alkaline aqueous solution was prepared.

Separately from the alkaline aqueous solution, 4.8 g (16.2 mmol) of 4,4'-oxybis(benzoyl chloride) and 4.1 g (16.2 mmol) of 2,6-naphthalenedicarboxylic acid dichloride were dissolved as aryloyl halides in 300 g of chloroform to prepare a chloroform solution.

Next, the chloroform solution was added into the alkaline aqueous solution while the alkaline aqueous solution was kept at 10° C. and the reaction vessel contents were stirred to initiate a polymerization reaction. The polymerization reaction was caused to proceed for 3 hours while the reaction vessel contents were stirred and the internal temperature of the reaction vessel was kept at 13±3° C. Thereafter, decantation was performed to remove an upper layer (water layer) from the reaction vessel contents to collect an organic layer.

Next, 500 mL of ion exchanged water was added into a three-necked flask having a capacity of 2 L, and then the collected organic layer was added into the flask. Furthermore, 300 g of chloroform and 6 mL of acetic acid were added into the flask. The three-necked flask contents were stirred at room temperature (25° C.) for 30 minutes. Thereafter, decantation was performed to remove an upper layer (water layer) from the three-necked flask contents to collect an organic layer. The collected organic layer was washed with 500 mL of ion exchanged water using a separatory funnel. Washing with ion exchanged water was repeated eight times, and thus the water-washed organic layer was obtained.

Next, the water-washed organic layer was filtered to collect a filtrate. Into a conical flask having a capacity of 3 L, 1.5 L of methanol was added. The collected filtrate was gradually dripped into the conical flask to give a precipitate. The precipitate was filtered off. The thus collected precipitate was vacuum dried for 12 hours at 70° C. As a result, the polyarylate resin (R-1-1) having a viscosity average molecular weight of 25,200 was obtained. The viscosity average molecular weight of the polyarylate resin (R-1-1) was measured according to a method described below. The viscosity average molecular weight of each of the polyarylate resins (R-1-2) to (R-1-5) and the polyarylate resins (R-2) to (R-4) were measured according to the same method.

(Measurement Method of Viscosity Average Molecular Weight)

The polyarylate resin (R-1-1) was dissolved in dichloromethane to prepare a sample solution in a concentration C of 6.00 g/L. Next, an Ubbelohde capillary viscometer with a flow time $t_0$ of dichloromethane, which is a solvent, of 136.16 seconds was used to measure a flow time t (unit: second) of the sample solution in a thermostatic water bath set at 20° C. Next, a viscosity average molecular weight (Mv) was calculated in accordance with formula (10) shown below $$Mv=3207\times\eta^{1.205} \quad (10)$$

In formula (10), $\eta=b/a$, $a=0.438\times\eta_{sp}+1$, $\eta_{sp}=t/t_0-1$, $t_0=136.16$ seconds, $b=100\times\eta_{sp}/C$, and C=6.00 g/L.

(Synthesis of Polyarylate Resin (R-1-2))

The polyarylate resin (R-1-2) having a viscosity average molecular weight of 35,200 was prepared according to the same method as the preparation method of the polyarylate resin (R-1-1) in all aspects other than that the amount of t-butylphenol was changed to 0.21 g (1.41 mmol).

(Synthesis of Polyarylate Resin (R-1-3))

The polyarylate resin (R-1-3) having a viscosity average molecular weight of 45,100 was prepared according to the same method as the preparation method of the polyarylate resin (R-1-1) in all aspects other than that the amount of t-butylphenol was changed to 0.17 g (1.10 mmol).

(Synthesis of Polyarylate Resin (R-1-4))

The polyarylate resin (R-1-4) having a viscosity average molecular weight of 17,900 was prepared according to the same method as the preparation method of the polyarylate resin (R-1-1) in all aspects other than that the amount of t-butylphenol was changed to 0.66 g (4.40 mmol).

(Synthesis of Polyarylate Resin (R-1-5))

The polyarylate resin (R-1-5) having a viscosity average molecular weight of 53,100 was prepared according to the same method as the preparation method of the polyarylate resin (R-1-1) in all aspects other than that the amount of t-butylphenol was changed to 0.14 g (0.93 mmol).

(Synthesis of Polyarylate Resin (R-2))

The polyarylate resin (R-2) having a viscosity average molecular weight of 30,100 was prepared according to the same method as the preparation method of the polyarylate resin (R-1-1) in all aspects other than that one of the aryloyl halides that was a starting material of the polyarylate resin (R-1-1) was changed to an aryloyl halide that was a starting material of the polyarylate resin (R-2). A total amount by mole of the aryloyl halides in synthesis of the polyarylate resin (R-2) was equal to a total amount by mole of the aryloyl halides in synthesis of the polyarylate resin (R-1-1).

(Synthesis of Polyarylate Resin (R-3))

The polyarylate resin (R-3) having a viscosity average molecular weight of 32,300 was prepared according to the same method as the preparation method of the polyarylate resin (R-1-1) in all aspects other than that an aromatic diol that was a starting material of the polyarylate resin (R-3) was used in addition to the aromatic diol that was a starting material of the polyarylate resin (R-1-1). A total amount by mole of the aromatic diols in synthesis of the polyarylate resin (R-3) was equal to a total amount by mole of the aromatic diol in synthesis of the polyarylate resin (R-1-1).

(Synthesis of Polyarylate Resin (R-4))

The polyarylate resin (R-4) having a viscosity average molecular weight of 30,500 was prepared according to the same method as the preparation method of the polyarylate resin (R-1-1) in all aspects other than that an aromatic diol that was a starting material of the polyarylate resin (R-4) was used in addition to the aromatic diol that was a starting material of the polyarylate resin (R-1-1), and one of the aryloyl halides that was a starting material of the polyarylate resin (R-1-1) was changed to an aryloyl halide that was a starting material of the polyarylate resin (R-4). A total amount by mole of the aromatic dials in synthesis of the polyarylate resin (R-4) was equal to a total amount by mole of the aromatic diol in synthesis of the polyarylate resin (R-1-1). A total amount by mole of the aryloyl halides in synthesis of the polyarylate resin (R-4) was equal to a total amount by mole of the aryloyl halides in synthesis of the polyarylate resin (R-1-1).

Next, $^1$H-NMR spectra of the synthesized polyarylate resins (R-1-1) to (R-1-5) and (R-2) to (R-4) were measured using a proton nuclear magnetic resonance spectrometer (product of JASCO Corporation, resonance frequency: 300 MHz), Chloroform-d was used as a solvent. Tetramethylsilane (TMS) was used as an internal standard sample. FIG. 9 shows the H-NMR spectrum of the polyarylate resin (R-1-1) as a representative example of the polyarylate resins (R-1-1) to (R-1-5) and (R-2) to (R-4). In FIG. 9, the horizontal axis represents chemical shift (unit: ppm) and the vertical axis represents signal intensity (unit: arbitrary unit). The $^1$H-NMR spectrum shown in FIG. 9 was used to confirm that the polyarylate resin (R-1-1) was obtained. Likewise, the $^1$H-NMR spectra of the other polyarylate resins (R-1-2) to (R-1-5) and (R-2) to (R-4) were used to confirm that the polyarylate resins (R-1-2) to (R-1-5) and (R-2) to (R-4) were obtained.

<Production of Photosensitive Member>

[Photosensitive Member (A-1)]

A vessel was charged with 2 parts by mass of the charge generating material (CGM-1), 65 parts by mass of the hole transport material (H-1), 35 parts by mass of the electron transport material (E-1), 100 parts by mass of the polyarylate resin (R-1-1) as a hinder resin, and 300 parts by mass of tetrahydrofuran as a solvent. A rod-shaped ultrasonic vibrator was used to mix the materials and the solvent in the vessel for 2 minutes to disperse the materials in the solvent. The materials and the solvent in the vessel were further mixed for 50 hours using a ball mill to disperse the materials in the solvent. Thus, an application liquid for photosensitive layer formation was obtained. The application liquid for photosensitive layer formation was applied onto a conductive substrate—an aluminum drum-shaped support—by dip coating. The applied application liquid for photosensitive layer formation was hot-air dried at 100° C. for 40 minutes. Thus, a photosensitive layer (thickness 27 μm) was formed on the conductive substrate. As a result, a single-layer photosensitive member (A-1) was obtained.

[Photosensitive Members (A-2) to (A-7) and (B-1) to (B-4)]

Photosensitive members (A-2) to (A-7) and (B-1) to (B-4) were obtained according to the same method as the above-described production method of the photosensitive member (A-1) in all aspects other than that the binder resins and the hole transport materials shown in Table 1 were used. R-1-1 to R-1-5 and R-2 to R-5 in the column titled "Type" under "Binder resin" in Table 1 respectively represent the polyarylate resins (R-1-1) to (R-1-5) and (R-2) to (R-5). R-6 in the column titled "Type" under "Binder resin" represents the polycarbonate resin (R-6).

<Measurement Method and Evaluation Method>

[Measurement of Strain at Break]

With respect to each of the photosensitive members (A-1) to (A-7) and (B-1) to (B-4) obtained as described above, the strain at break of the photosensitive layer of the photosensitive member was measured. The following describes a method for measuring the strain at break. After producing the photosensitive member as described above, the photosensitive layer was removed from the drum-shaped support of the photosensitive member. Next, a sample having a size of 3 mm×30 mm was cut out from the photosensitive layer. Next, the sample was mounted in the tensile tester ("AUTOGRAPH (registered Japanese trademark) AGS-J 5kN", product of Shimadzu Corporation). The sample was mounted with a distance between clamps of the tensile tester adjusted to 8 mm. Next, the sample was pulled at a pulling speed of 5 mm/minute under environmental conditions of a temperature of 23° C. and a relative humidity of 50% to plot a stress-strain curve. The strain at break was determined from the stress-strain curve. The results are shown in Table 1.

[Measurement of Scratch Depth]

With respect to each of the photosensitive members (A-1) to (A-7) and (B-1) to (B-4) obtained as described above, the scratch depth of the photosensitive layer of the photosensitive member was measured. The scratch depth was measured according to a method described below using a scratching apparatus 200 (see FIG. 5) in accordance with Japanese Industrial Standard (JIS) K5600-5-5 (K5600: testing methods for paints, Part 5: mechanical property of film, Section 5: scratch hardness (stylus method)).

Figure 5:
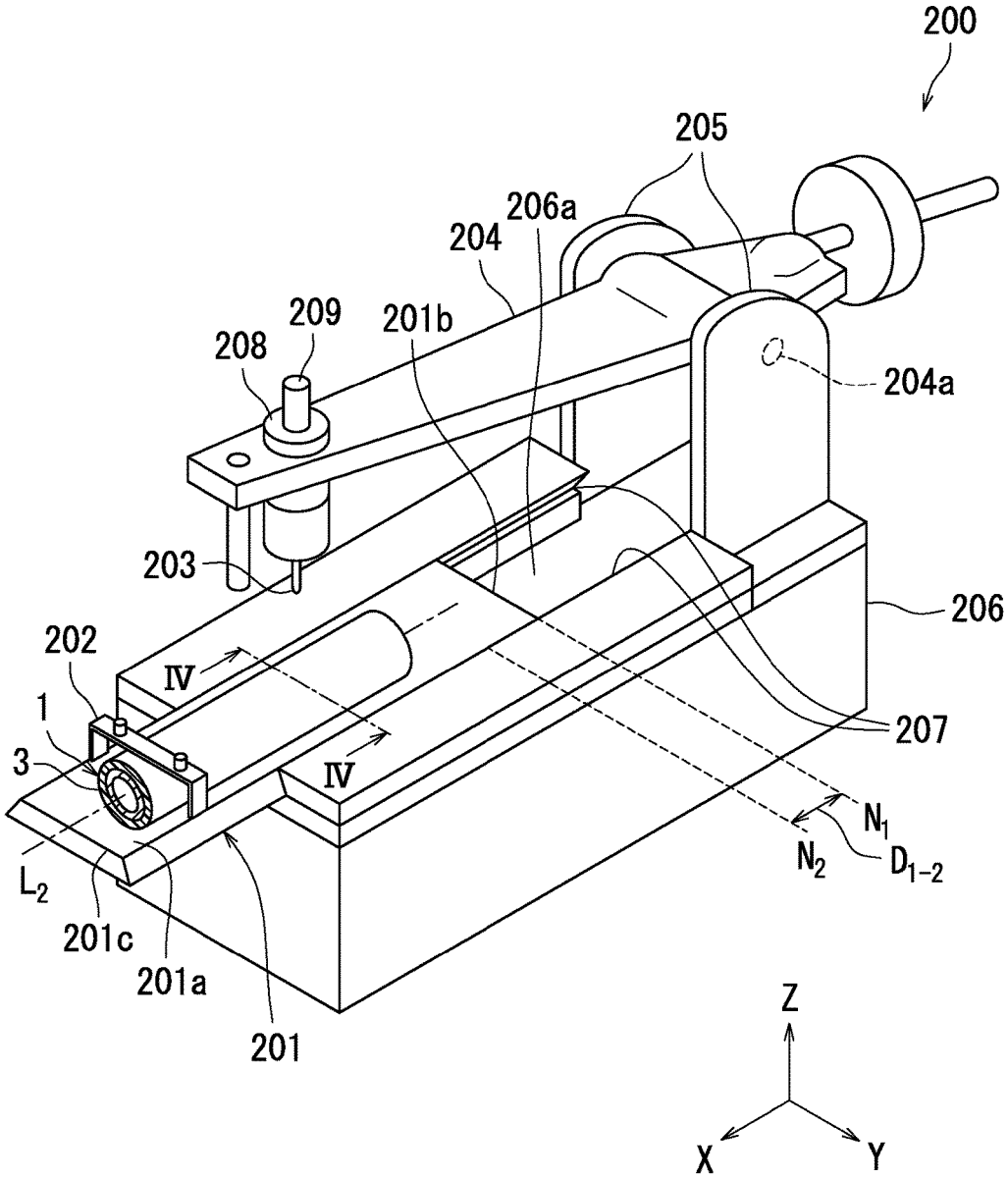
FIG. 5 is a diagram illustrating an example of a configuration of a scratching apparatus.

The following describes the scratching apparatus 200 in accordance with JIS K5600-5-5 with reference to FIG. 5. FIG. 5 is a diagram illustrating an example of a configuration of the scratching apparatus 200. The scratching apparatus 200 includes a fixture 201, a retainer 202, a scratching stylus 203, a support arm 204, two shaft supports 205, a base 206, two rails 207, a weight pan 208, and a constant speed motor (not shown). A weight 209 is placed on the weight pan 208.

In FIG. 5, an X axis direction and a Y axis direction are each a horizontal direction, and a Z axis direction is a vertical direction. The X axis direction indicates a longitudinal direction of the fixture 201. The Y axis direction intersects with the X axis direction on a plane parallel with an upper surface (loading surface) 201*a* of the fixture 201. Note that an X axis direction, a Y axis direction, and a Z axis direction in FIGS. 6 to 8 described below are the same as defined in FIG. 5.

The fixture 201 is equivalent to a test piece fixture according to JIS K5600-5-5. The fixture 201 has the upper surface 201*a*, an end 201*b*, and an opposite end 201*c*. The upper surface 201*a* of the fixture 201 is a horizontal surface. The end 201*b* faces toward the two shaft supports 205.

The retainer 202 is disposed on the upper surface 201*a* of the fixture 201 in a position closer to the opposite end 201*c* than to the end 201*b*. The retainer 202 fixes a measurement target (photosensitive member 1) to the upper surface 201*a* of the fixture 201.

Figure 6:
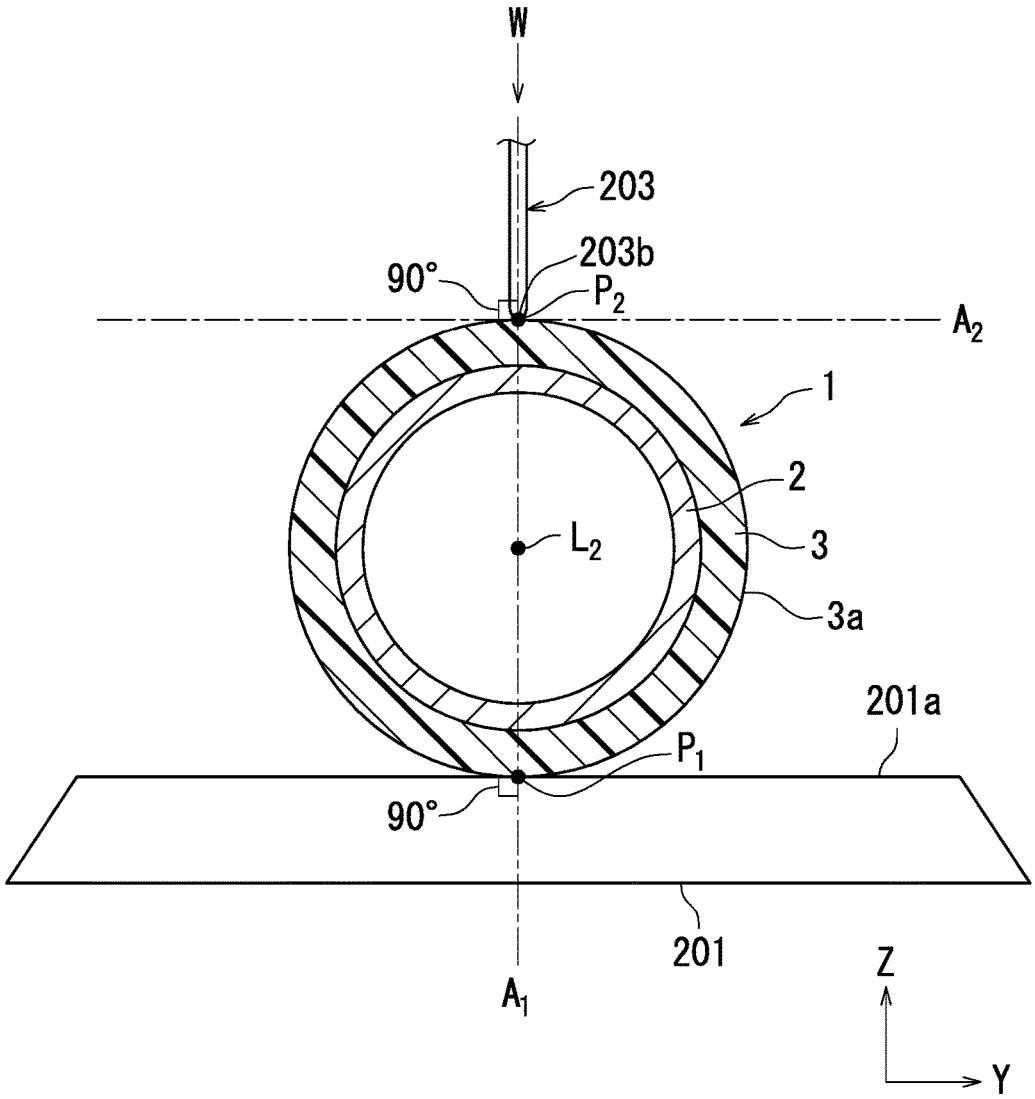
FIG. 6 is a cross-sectional view taken along IV-IV line in FIG. 5.

The scratching stylus 203 has a tip 203*b* (see FIG. 6). The tip 203*b* has a semispherical structure having a diameter of 1 mm. The tip 203*b* is made from sapphire.

The support arm 204 supports the scratching stylus 203. The support arm 204 pivots about a shaft 204*a* in directions that the scratching stylus 203 moves toward and away from the photosensitive member 1.

The two shaft supports 205 pivotally support the support arm 204.

The base 206 has an upper surface 206*a*. The two shaft supports 205 are disposed at an end of the upper surface 206*a*.

The two rails 207 are disposed at an opposite end of the upper surface 206*a*, The two rails 207 are opposed in parallel with each other. The two rails 207 are in parallel with the longitudinal direction (X axis direction) of the fixture 201. The fixture 201 is disposed between the two rails 207. The fixture 201 is horizontally movable along the rails 207 in the longitudinal direction (X axis direction) of the fixture 201.

The weight pan 208 is disposed on the scratching stylus 203 with the support arm 204 therebetween. The weight 209 is placed on the weight pan 208.

The constant speed motor causes the fixture 201 to move along the rails 207 in the X axis direction.

The following describes a measurement method of the scratch depth. The measurement method of the scratch depth includes first to fourth steps. A surface property tester ("HEIDON TYPE 14", product of Shinto Scientific Co., Ltd.) was used as the scratching apparatus 200. The scratch depth was measured under environmental conditions of a temperature of 23° C. and a relative humidity of 50%. The photosensitive member 1 was drum-shaped (cylindrical).

(First Step)

In the first step, the photosensitive member 1 was fixed to the upper surface 201*a* of the fixture 201 with a longitudinal direction of the photosensitive member 1 in parallel with the longitudinal direction of the fixture 201. The photosensitive member 1 was loaded such that a direction of a central axis $L_2$ (rotation axis) of the photosensitive member 1 was in parallel with the longitudinal direction of the fixture 201.

(Second Step)

In the second step, the scratching stylus 203 was brought into vertical contact with a surface 3*a* of a photosensitive layer 3. The following describes how the scratching stylus 203 was brought into vertical contact with the surface 3*a* of the photosensitive layer 3 of the drum-shaped photosensitive member 1 with reference to FIGS. 6 and 7 in addition to FIG. 5.

Figure 7:
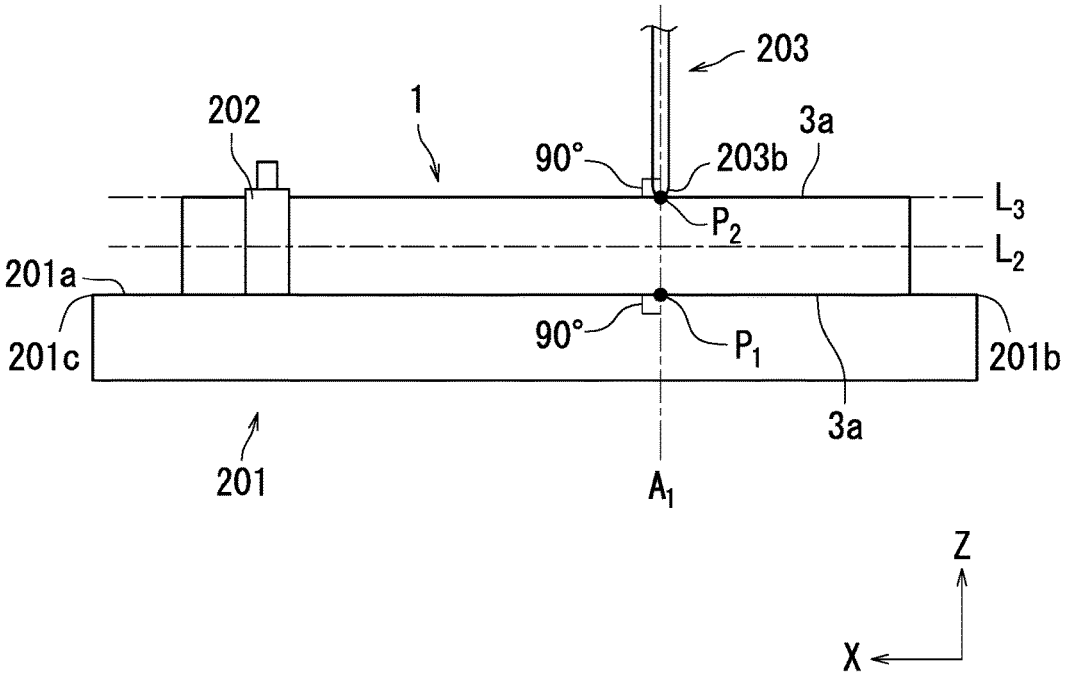
FIG. 7 is a side view of a fixture, a scratching stylus, and an electrophotographic photosensitive member illustrated in FIG. 5.

FIG. 6 is a cross-sectional view of the photosensitive member 1 in contact with the scratching stylus 203, taken along line in FIG. 5. FIG. 7 is a side view of the fixture 201, the scratching stylus 203, and the photosensitive member 1 illustrated in FIG. 5.

The scratching stylus 203 was moved toward the photosensitive member 1 such that an extension of a central axis $A_1$ of the scratching stylus 203 was perpendicular to the upper surface 201*a* of the fixture 201. Next, the tip 203*b* of the scratching stylus 203 was brought into contact with a point (contact point $P_2$) on the surface 3*a* of the photosensitive layer 3 of the photosensitive member 1. The location of the contact point $P_2$ was farthest from the upper surface 201*a* of the fixture 201 in the vertical direction (Z axis direction) among possible locations on the surface 3*a*. Thus, the tip 203*b* of the scratching stylus 203 was brought into contact with the photosensitive member 1 such that the central axis $A_1$ of the scratching stylus 203 was perpendicular to a tangent $A_2$. In such an arrangement, a line connecting a contact point $P_1$ in contact with the upper surface 201*a* and the contact point $P_2$ in contact with the tip 203*b* was perpendicular to the central axis $L_2$ of the photosensitive member 1. The tangent $A_2$ touches, at the contact point $P_2$, a perimeter circle of a cross-section of the photosensitive member 1 taken in a direction perpendicular to the central axis $L_2$.

(Third Step)

The following describes the third step with reference to FIGS. 5 and 6. In the third step, a load W of 10 g was applied from the scratching stylus 203 to the photosensitive layer 3 with the scratching stylus 203 in vertical contact with the surface 3*a* of the photosensitive layer 3. Specifically, the weight 209, which weighed 10 g, was placed on the weight pan 208. With the load W being applied to the photosensitive layer 3, the fixture 201 was caused to move. Specifically, the constant speed motor was driven to cause the fixture 201 to horizontally move in the X axis direction along the rails 207. That is, the end 201*h* of the fixture 201 moved from a first position $N_1$ to a second position $N_2$. The second position $N_2$ was located downstream of the first position $N_1$ in terms of a direction that the fixture 201 moves away from the two shaft supports 205 in the longitudinal direction of the fixture 201. The photosensitive member 1 horizontally moved in the longitudinal direction of the fixture 201 as the fixture 201 moved in the longitudinal direction. The fixture 201 and the photosensitive member 1 moved at a rate of 30 mm/minute. The fixture 201 and the photosensitive member 1 moved by a distance of 30 mm. The distance by which the fixture 201 and the photosensitive member 1 moved was equal to a distance $D_{1-2}$ between the first position $N_1$ and the second position $N_2$. As a result of the fixture 201 and the photosensitive member 1 moving, the scratching stylus 203 created a scratch S on the surface 3*a* of the photosensitive layer 3 of the photosensitive member 1.

The following describes the scratch S with reference to FIG. 8 in addition to FIGS. 5 to 7. FIG. 8 illustrates the scratch S created on the surface 3*a* of the photosensitive layer 3. The scratch S had a depth in a direction perpendicular both to the upper surface 201*a* of the fixture 201 and to the tangent $A_2$. The scratch S followed a line $L_3$ illustrated in FIG. 7. The line $L_3$ included a plurality of the contact points P2. The line $L_3$ was parallel with the upper surface 201*a* of the fixture 201 and with the central axis $L_2$ of the photosensitive member 1. The line was perpendicular to the central axis $A_1$ of the scratching stylus 203.

(Fourth Step)

In the fourth step, the scratch depth was measured, which is a greatest value of a depth Ds of the scratch S. Specifically, the photosensitive member 1 was removed from the fixture 201. A three dimensional interference microscope ("WYKO NT-1100", product of Bruker Corporation) was used to observe the scratch S created on the photosensitive layer 3 of the photosensitive member 1 at a magnification of ×5 to measure the depth Ds of the scratch S. The depth Ds of the scratch S was defined as a distance between the tangent $A_2$ and a bottom of the scratch S. The greatest value of the measured values of the depth Ds of the scratch S was taken to be the scratch depth. Table 1 shows the scratch depth measured as described above.

[Evaluation of Anti-Fogging Performance]

With respect to each of the photosensitive members (A-1) to (A-7) and (B-1) to (B-4) obtained as described above, anti-fogging performance indicated by an image formed using the photosensitive member was evaluated. An image forming apparatus (a modified version of "monochrome printer FS-1300D", product of KYOCERA Document Solutions Inc.) was used as an evaluation apparatus. The image forming apparatus adopts a direct transfer process, a contact development process, and a cleaner-less process. In the image forming apparatus, a development section cleans toner remaining on a photosensitive member. A charger of the image forming apparatus is a charging roller. "KYOCERA Document Solutions-brand paper VM-A4" sold by KYOCERA Document Solutions Inc. (A4 size) was used. A one-component developer (test sample) was used in the evaluation using the evaluation apparatus.

The evaluation apparatus was used to print an image I on 15,000 successive sheets of the paper under conditions of a photosensitive member rotational speed of 168 mm/second and a charge potential of +600 V. The image I had a coverage of 1%. Subsequently, a blank image was printed on a sheet of the paper. The printing was performed under environmental conditions of a temperature of 10° C. and a relative humidity of 15%. An image density of each of three sections in the printed blank image was measured using a reflectance densitometer ("RD914", product of X-Rite Inc.). A sum of the image densities of the three sections of the blank image was divided by three. Thus, a number average image density of the blank image was obtained. A value calculated by subtracting an image density of the paper that was not subjected to printing from the number average image density of the blank image was taken to be a fogging density. The thus obtained fogging density was rated in accordance with the following rating standard. Anti-fogging performance of the photosensitive member was evaluated as good if the image fogging density thereof was rated as A or B. Anti-fogging performance of the photosensitive member was evaluated as poor if the image fogging density thereof was rated as C. The fogging density (FD) and the rating results are shown in Table 1.

(Rating Standard for Anti-Fogging Performance)

A: Fogging density≤0.010

B: 0.010<Fogging density≤0.020

C: 0.020<Fogging density

[Evaluation of Abrasion Resistance]

With respect to each of the photosensitive members (A-1) to (A-7) and (B-1) to (B-4) obtained as described above, abrasion resistance was evaluated. The following describes an evaluation method of abrasion resistance. The thickness of the photosensitive layer of the photosensitive member was measured using an eddy current thickness gauge before the anti-fogging performance evaluation described above. The thickness of the photosensitive layer of the photosensitive member was measured using the eddy current thickness gauge again after the anti-fogging performance evaluation described above. Next, a thickness loss of the photosensitive layer of the photosensitive member was calculated from the thickness measured before the anti-fogging performance evaluation and the thickness measured after the anti-fogging performance evaluation. The calculated thickness loss was taken to be an abrasion amount (unit: μm). The results are shown in Table 1. Evaluation was carried out on the assumption that a smaller abrasion amount indicates higher abrasion resistance.

TABLE 1

| | Photo-sensitive member | Binder resin Type | Viscosity average molecular weight | Hole transport material | Strain at break (%) | Scratch depth (μm) | Abrasion amount (μm) | Anti-fogging performance FD value | Rating |
|---|---|---|---|---|---|---|---|---|---|
| Example 1 | A-1 | R-1-1 | 25,200 | H-1 | 7.2 | 0.31 | 5.2 | 0.004 | A |
| Example 2 | A-2 | R-1-2 | 35,200 | H-1 | 10.6 | 0.32 | 4.3 | 0.005 | A |
| Example 3 | A-3 | R-1-3 | 45,100 | H-1 | 12.2 | 0.33 | 2.9 | 0.004 | A |
| Example 4 | A-4 | R-2 | 30,100 | H-1 | 9.3 | 0.11 | 3.8 | 0.001 | A |
| Example 5 | A-5 | R-3 | 32,300 | H-1 | 9.1 | 0.31 | 4.0 | 0.004 | A |
| Example 6 | A-6 | R-4 | 30,500 | H-1 | 9.2 | 0.21 | 4.2 | 0.003 | A |
| Example 7 | A-7 | R-1-2 | 35,200 | H-2 | 6.7 | 0.34 | 5.7 | 0.004 | A |
| Comparative Example 1 | B-1 | R-1-4 | 17,900 | H-1 | 4.8 | 0.34 | 7.4 | 0.067 | C |
| Comparative Example 2 | B-2 | R-1-5 | 53,100 | H-1 | 14.2 | 0.30 | 1.1 | 0.023 | C |
| Comparative Example 3 | B-3 | R-5 | 35,200 | H-1 | 18.2 | 0.75 | 0.9 | 0.031 | C |
| Comparative Example 4 | B-4 | R-6 | 40,200 | H-1 | 5.2 | 0.88 | 5.8 | 0.101 | C |

As shown in Table 1, the binder resin in each of the photosensitive members (A-1) to (A-7) had a viscosity average molecular weight of at least 25,200 and no greater than 45,100. The strain at break of the photosensitive layer of each of the photosensitive members (A-1) to (A-7) was at least 6.7% and no greater than 12.2%. The scratch depth of the photosensitive layer of each of the photosensitive members (A-1) to (A-7) was no greater than 0.34 μm. The abrasion amount of each of the photosensitive members (A-1) to (A-7) was at least 2.9 μm and no greater than 5.7 μm. Anti-fogging performance of each of the photosensitive members (A-1) to (A-7) was evaluated as good with a fogging density rated as A.

As shown in Table 1, the binder resin in the photosensitive member (B-1) had a viscosity average molecular weight of less than 25,000, and the strain at break of the photosensitive layer of the photosensitive member (B-1) was less than 4.9%. The binder resin in the photosensitive member (B-2) had a viscosity average molecular weight of greater than 50,000, and the strain at break of the photosensitive layer of the photosensitive member (B-2) was greater than 13.0%. The strain at break of the photosensitive layer of the photosensitive member (B-3) was greater than 13.0%, and the scratch depth of the photosensitive layer of the photosensitive member (B-3) was greater than 0.50 μm. The scratch depth of the photosensitive layer of the photosensitive member (B-4) was greater than 0.50 μm. The abrasion amount of each of the photosensitive members (B-1) and (B-4) was at least 5.8 μm. Anti-fogging performance of each of the photosensitive members (B-1) to (B-4) was evaluated as poor with a fogging density rated as C.

As apparent from Table 1, the photosensitive members (A-1) to (A-7) had higher abrasion resistance than the photosensitive members (B-1) and (B-4). The photosensitive members (A-1) to (A-7) also exhibited higher anti-fogging performance than the photosensitive members (B-1) to (B-4).

What is claimed is:

1. An electrophotographic photosensitive member comprising a conductive substrate and a photosensitive layer, wherein the photosensitive layer is a single-layer photosensitive layer and contains a charge generating material, a hole transport material, an electron transport material, and a binder resin, the binder resin has a viscosity average molecular weight of at least 25,000 and no greater than 50,000, a strain at break of the photosensitive layer is at least 4.9% and no greater than 13.0%, the strain at break being a value determined from a stress-strain curve obtained by pulling the photosensitive layer using a tensile tester at a rate of 5 mm/minute, a scratch resistant depth of the photosensitive layer is no greater than 0.50 μm, the scratch resistant depth being a value measured through first to fourth steps described below using a scratching apparatus in accordance with JIS K5600-5-5, the scratching apparatus includes a fixture and a scratching stylus, the scratching stylus has a semispherical sapphire tip having a diameter of 1 mm, in the first step, the photosensitive member is fixed to an upper surface of the fixture with a longitudinal direction of the photosensitive member in parallel with a longitudinal direction of the fixture, in the second step, the scratching stylus is brought into vertical contact with a surface of the photosensitive layer, in the third step, the fixture and the photosensitive member fixed to the upper surface of the fixture are caused to move by 30 mm at a rate of 30 mm/minute in the longitudinal direction of the fixture while a load of 10 g is applied from the scratching stylus to the photosensitive layer, in the fourth step, the greatest depth of a scratch created on the surface of the photosensitive layer through the third step is measured as the scratch resistant depth, and the binder resin includes a polyarylate resin represented by general formula (1) shown below (1)

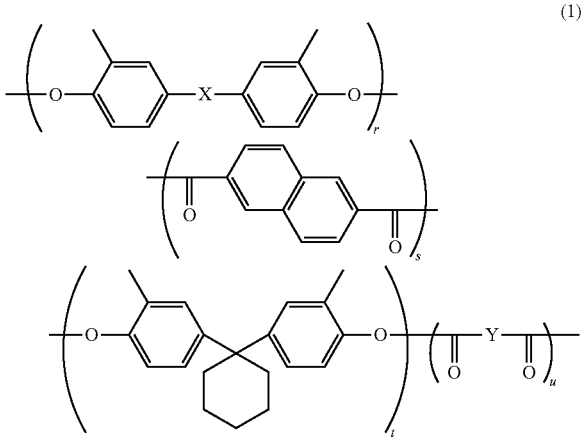

where in general formula (1), r, s, t, and u each represent, independently of one another, a number greater than or equal to 0 r+s+t+u=100, r+t=s+u, r/(r+t) is at least 0.00 and no greater than 0.90, s/(s+u) is at least 0.00 and no greater than 0.90, X is a divalent group represented by chemical formula (1A) or (1B) shown below, and Y is a divalent group represented by chemical formula (2A) or (2B) shown below (1A)

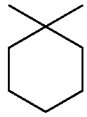

(1B)

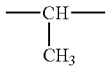

(2A)

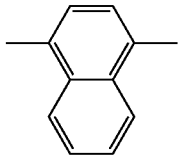

(2B)

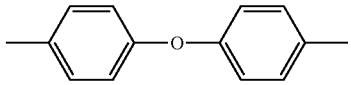

2. The electrophotographic photosensitive member according to claim 1, wherein in general formula (1), Y is a divalent group represented by chemical formula (2A).

3. The electrophotographic photosensitive member according to claim 1, wherein the polyarylate resin is represented by chemical formula (R-1), chemical formula (R-2), chemical formula (R-3), or chemical formula (R-4) shown below (R-1)

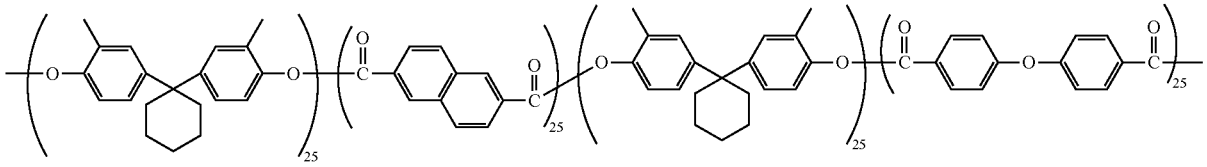

(R-2)

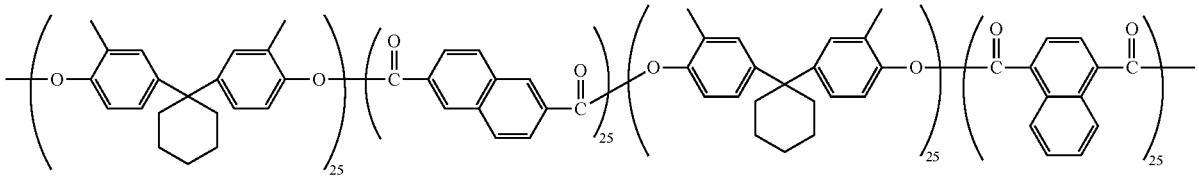

(R-3)

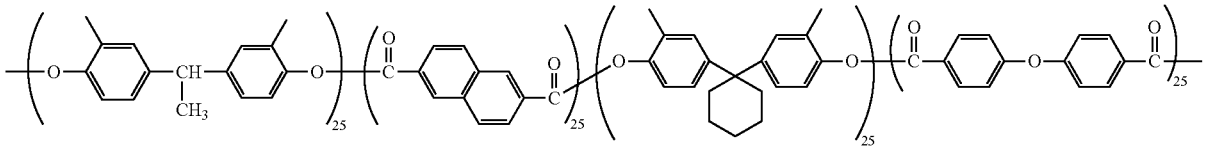

(R-4)

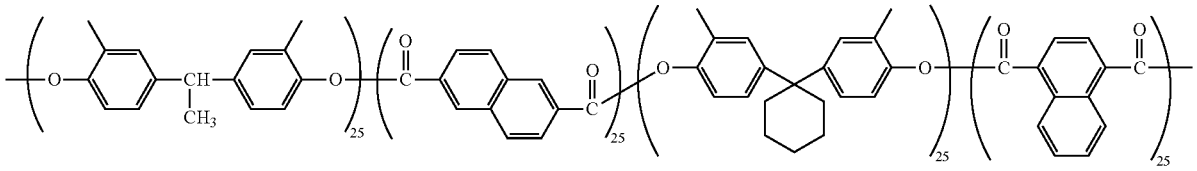

4. The electrophotographic photosensitive member according to claim 1, wherein the hole transport material includes a compound represented by general formula (HTM) shown below, (HTM)

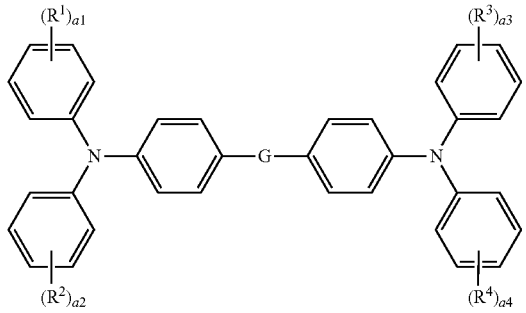

where in general formula (HTM), $R^1$, $R^2$, $R^3$, and $R^4$ each represent, independently of one another, an alkyl group having a carbon number of at least 1 and no greater than 6 or an alkoxy group having a carbon number of at least 1 and no greater than 6, a1, a2, a3, and a4 each represent, independently of one another, an integer of at least 0 and no greater than 5, a1, a2, a3, and a4 do not all simultaneously represent 0, when a1 represents an integer of at least 2 and no greater than 5, chemical groups $R^1$ may be the same as or different from one another, when a2 represents an integer of at least 2 and no greater than 5, chemical groups $R^2$ may be the same as or different from one another, when a3 represents an integer of at least 2 and no greater than 5, chemical groups $R^3$ may be the same as or different from one another, when a4 represents an integer of at least 2 and no greater than 5, chemical groups $R^4$ may be the same as or different from one another, and G represents a single bond or a p-phenylene group.

5. The electrophotographic photosensitive member according to claim 4, wherein in general formula (HTM), $R^1$, $R^2$, $R^3$, and $R^4$ each represent a methoxy group.

6. The electrophotographic photosensitive member according to claim 5, wherein the hole transport material includes a compound represented by chemical formula (H-1) shown below (H-1)

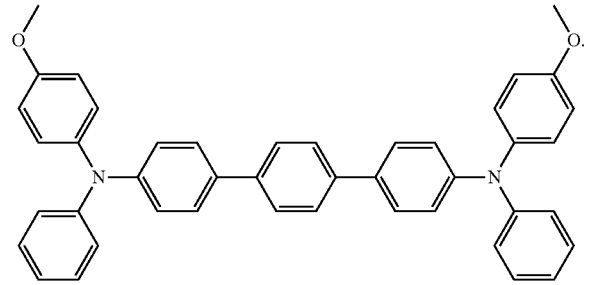

7. A process cartridge comprising the electrophotographic photosensitive member according to claim 1.

8. An image forming apparatus comprising:

an image bearing member;

a charger configured to charge a surface of the image bearing member;

a light exposure section configured to expose the charged surface of the image bearing member to light to form an electrostatic latent image on the surface of the image bearing member;

a development section configured to develop the electrostatic latent image into a toner image; and a transfer section configured to transfer the toner image from the image bearing member to a transfer target, wherein the image bearing member is the electrophotographic photosensitive member according to claim 1, the charger has a positive charging polarity, and the transfer section transfers the toner image from the image bearing member to the transfer target while bringing the transfer target into contact with the surface of the image bearing member.

9. The image forming apparatus according to claim 8, wherein the charger is a charging roller.

10. The image forming apparatus according to claim 8, wherein the development section develops the electrostatic latent image into the toner image while in contact with the surface of the image bearing member.

11. The image forming apparatus according to claim 8, wherein the development section cleans the surface of the image bearing member.

* * * * *